US012084775B1

(12) United States Patent
Trueman et al.

(10) Patent No.: US 12,084,775 B1
(45) Date of Patent: Sep. 10, 2024

(54) PASSIVATION OF COPPER-NICKEL ALLOY CONDUITS FOR MARINE USE

(71) Applicant: The United States of America, as represented by the Secretary of the Navy, Arlington, VA (US)

(72) Inventors: Elissa M. Trueman, Leesburg, VA (US); Jacob R. Steiner, Bethesda, MD (US); Peter K. Todoroff, Blacksburg, VA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 321 days.

(21) Appl. No.: 16/898,874

(22) Filed: Jun. 11, 2020

(51) Int. Cl.
*C23C 22/73* (2006.01)
*C23C 22/63* (2006.01)

(52) U.S. Cl.
CPC ..... *C23C 22/73* (2013.01); *C23C 22/63* (2013.01)

(58) Field of Classification Search
CPC ..... C23C 22/73; C23C 22/68; C23C 22/63
See application file for complete search history.

(56) References Cited

U.S. PATENT DOCUMENTS

| | | | |
|---|---|---|---|
| 6,524,402 | B1 | 2/2003 | Broutin et al. |
| 11,230,782 | B2 | 1/2022 | Lee et al. |
| 2017/0014874 | A1 | 1/2017 | Turner et al. |
| 2017/0018319 | A1 | 1/2017 | Martynov et al. |

FOREIGN PATENT DOCUMENTS

| | | | | |
|---|---|---|---|---|
| CN | 103757627 | * | 4/2014 | |
| JP | 6354814 B2 | * | 7/2018 | ..... C23C 22/68 |

OTHER PUBLICATIONS

Department of Defense, United States of America, Military Standard: Corrosion-Resistent Steel Parts: Sampling, Inspection and Testing for Surface Passivation, Jun. 29, 1990, p. 1-15 (Year: 1990).*

Copper Development Association, Seawater System Design: Guidelines, Dec. 1, 2015, p. 1-28 (Year: 2015).*

Powell, Copper-Nickel for Seawater Corrosion Resistance and Antifouling: A State of the Art Review, Corrosion 2000, Paper No. 627, NACE International, Houston, TX, p. 1-17 (Year: 2000).*

Trueman, Corrosion Engineering for US Navy Ships, slideshow presentation, Apr. 15, 2019, p. 1-22 (Year: 2019).*

(Continued)

*Primary Examiner* — Tabatha L Penny
(74) *Attorney, Agent, or Firm* — Howard Kaiser

(57) ABSTRACT

According to exemplary practice of the present invention, a passivation solution is circulated in a closed loop so as to laminarly flow on a continual basis through the channels of copper-nickel alloy piping or tubing. The passivation solution consists essentially of seawater (natural and/or artificial) plus 0.5 mM nickel hydroxide additive. The cyclical flow of the passivation solution is administered to the piping/tubing for a selected period of time (e.g., seven days), resulting in growth of a corrosion-resistant film on the inside (channel) surfaces of the piping/tubing. The film thus formed consists essentially of nickel hydroxide, nickel oxide, and copper oxide, and represents a durable and effective anti-corrosive barrier when exposed to seawater.

17 Claims, 17 Drawing Sheets

(56) References Cited

OTHER PUBLICATIONS

"Nickel(II) hydroxide," Wikipedia, 4 pages, https://en.wikipedia.org/w/index.php?title=Nickel(II)_hydroxide&oldid=930234659, webpage last edited on Dec. 11, 2019.

Elissa M. Trueman, Jacob R. Steiner, and Peter K. Todoroff, "Propargyl Alcohol as a Corrosion Inhibitor for Copper Nickel Alloys," slideshow presentation (22 pages; two versions submitted herewith), presented on Apr. 15, 2019 at Ohio University, graduate seminar, Russ College of Engineering and Technology, Department of Chemical and Biomolecular Engineering, Institute for Corrosion and Multiphase Technology, Ohio University's Research and Enterprise Park, Athens, Ohio.

Elissa M. Trueman, Jacob R. Steiner, and Peter K. Todoroff, "Corrosion Engineering for US Navy Ships," slideshow presentation (22 pages; two versions submitted herewith), presented on Apr. 15, 2019 at Ohio University, undergraduate corrosion class, Russ College of Engineering and Technology, Department of Chemical and Biomolecular Engineering, Institute for Corrosion and Multiphase Technology, Ohio University's Research and Enterprise Park, Athens, Ohio.

Jacob R. Steiner and Elissa M. Trueman, "Passivation Treatments for Copper-Nickel Alloys Exposed to Seawater," paper (10 pages), 2019 DoD-Allied Nations Technical Corrosion Conference, Oklahoma City, OK, Aug. 12-15, 2019.

Jacob R. Steiner and Elissa M. Trueman, "Passivation Treatments for Copper-Nickel Alloys Exposed to Seawater," slideshow presentation (13 pages), 2019 DoD-Allied Nations Technical Corrosion Conference, Oklahoma City, OK, Aug. 12-15, 2019.

David A. Shifler, "Copper-Nickel Cladding on Stainless Steel," Naval Surface Warfare Center, Carderock Division, NSWCCD-TR-61-2005/12, report date Jul. 2005, approved for public release, distribution is unlimited (36 pages).

"Passivation: An extra layer of protection for critical equipment," Jun. 28, 2019, Cleanroom Technology website, https://cleanroomtechnology.com/news/article_page/Passivation_An_extra_layer_of_protection_for_critical_equipment/155895, 10 pages printed out on Feb. 15, 2022.

"Passivation (chemistry)," Wikipedia, 9 pages, https://en.wikipedia.org/w/index.php?title=Passivation_(chemistry)&oldid=1072067672, webpage last edited on Feb. 15, 2022.

* cited by examiner

| Flow Regime | Chemistry + ASTM D1141 Substitute Ocean water | Concentration | Duration (days) |
|---|---|---|---|
| Passivation | Nickel hydroxide ($Ni(OH)_2$) | 0.5 mM | 7 |
| | None | N/A | 21 |
| Durability | Sodium Sulfide ($Na_2S$) | 2.2 μM (70 ppb $S^{2-}$) | 7 |
| | None | N/A | 7 |

FIG. 5

| Regime | Rotating Cylinder | Pipe | Expected Wall Shear Stress, τ (Pa) |
|---|---|---|---|
| | Angular Velocity, ω (rotations·$s^{-1}$) | Mean Pipe Velocity, υ (m/s) | |
| Passivation (Laminar) | 0.75 | $1.66*10^{-3}$ | $2.70*10^{-3}$ |
| Durability (Turbulent) | 307 | 2.286 | 19 |

FIG. 6

PASSIVATION OF COPPER-NICKEL ALLOY CONDUITS FOR MARINE USE

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

The present invention relates to passivation of metal and alloy structures and materials, more particularly to passivation of metal and alloy conduits, such as piping and tubing, for utilization thereof in saltwater environments.

Copper nickel alloys (CuNi) are used extensively onboard ships and other marine vessels for piping and tubing in flowing seawater applications, such as heat exchangers and fire main systems. CuNi materials are often chosen for such purposes due to their thermal, electrical, and mechanical properties, biofouling resistance, ease of fabrication and joining, and corrosion resistance once passivated.

According to current practice, marine usage of copper nickel alloys requires an extensive passivation period prior to in-service conditions, to ensure appropriate function and corrosion resistance during their lifetime. The current edition of the Naval Ships Technical Manual, Chapter 254 (entitled "Condensers, Heat Exchangers, and Air Injectors"), section 254-2.6.15.1, requires tubing to be passivated for "as long as practical" in clean, flowing seawater prior to first use. The minimum period of passivation time has been conventionally accepted to be twenty-one days, based on work performed by the Copper Development Association Inc.

Nevertheless, the customary 21-day passivation period hinders schedules and increases costs during construction and maintenance of systems. Due to issues with pollution in port environments, the cost of delivering clean, natural seawater for this operation can be prohibitive in terms of completing this passivation. In addition, following chemical cleaning operations that require re-passivation of tubing, the requisite 21-day passivation period can cause difficulties in maintaining ship schedules.

SUMMARY OF THE INVENTION

In view of the foregoing, an object of the present invention is to provide a better methodology for passivating metal and alloy conduits, such as tubes and pipes.

Another object of the present invention is to provide such a methodology that can be efficiently and effectively performed in shorter time periods.

In accordance with exemplary practice of the present invention, a passivation method includes providing a passivation solution consisting essentially of seawater and 0.5 mM nickel hydroxide, and effecting a continuous flow of the passivation solution through a copper-nickel alloy conduit. The seawater is natural seawater or artificial seawater or a combination thereof. The copper-nickel alloy conduit is characterized by a conduit length and an inside conduit surface. The continuous flow of the passivation solution is effected contiguously with respect to the inside conduit surface along substantially the entire conduit length. The continuous flow of the passivation solution results in formation, on the inside conduit surface and along substantially the entire conduit length, of a passivation film consisting essentially of nickel hydroxide, nickel oxide, and copper oxide. The continuous flow of the passivation solution is substantially laminar along substantially the entire conduit length. The period of time during which said continuous flow of said passivation solution is effected may depend on the requirements of a given application of the present invention.

The present inventors investigated the effects of various dopant chemistries in substitute ocean water with a goal of reducing common copper-nickel alloy passivation periods. A main objective of their research was to determine how, through the use of dopants, to reduce passivation periods from twenty-one days (504 hours) to seven days (168 hours). They investigated various chemicals that can be added to seawater to achieve passive film formation on copper-nickel alloy surfaces within seven days.

The present inventors' earlier research in this regard was in the nature of a screening study, and is described in the following paper, hereby incorporated herein by reference: Jacob R. Steiner and Elissa M. Trueman, "Copper-Nickel Alloys Exposed to Seawater," 2019 DoD-Allied Nations Technical Corrosion Conference, Oklahoma City, OK, 12-15 Aug. 2019. The present inventors used an extruded and annealed cylindrical bar made of copper nickel alloy UNS C70600, with ⅜ inch outer diameter. Disk-shaped specimens were cut from the bar to a thickness of 0.125 inches. All of the specimens were ground to 600 grit silicon carbide with water, rinsed in ethanol, rinsed in deionized water, and air dried. The specimens were stored in a vacuum-sealed desiccator prior to testing.

The testing was conducted by the present inventors with respect to five different passivation dopant chemistries each characterized by addition of a particular substance to artificial seawater (ASTM SW), and also with respect to unadulterated ASTM SW as a control chemistry. The five passivation chemistries were: citric acid ($C_6H_8O_7$) additive at concentration 5 mM; nickel hydroxide ($Ni(OH)_2$) additive at concentration 0.5 mM; potassium iodide (KI)+L-leucine ($C_6H_{13}NO_2$) additive at concentration 1 μM KI+5 UM $C_6H_{13}NO_2$; nickel sulfate ($NiSO_4$) additive at concentration 12.5 mM; and propargyl alcohol ($C_3H_4O$) additive at concentration 1 mM.

The five passivation chemistries were each examined for film thickness and amount of copper released. The film thickness provided insight into a passive film's ability to protect the CuNi surface from corrosion. The disk-shaped specimens were each exposed for seven days, both quiescently and flowingly, to each dopant chemistry. In addition, separate control-chemistry (ASTM SW) specimens were exposed for twenty-one days.

Specimens exposed to nickel hydroxide ($Ni(OH)_2$) formed surface films 0.271 μm thicker than the ASTM SW films formed in quiescent exposures, and were equivalent to those formed in ASTM SW in flowing exposures (0.015 μm difference). The amount of Cu dissolved in solution decreased by 39.81 mg/L Cu from ASTM SW exposed for 21 days in quiescent exposures and by 21.92 mg/L Cu in flowing exposures. The amount of copper detected in quiescent and flowing exposures was fairly equivalent (5.20 mg/L Cu quiescent versus 5.17 mg/L Cu flowing). The surface films were not noticeably different colors from those formed on 90/10 CuNi in ASTM SW. Even without the desired color change, nickel hydroxide demonstrated promise as a viable seven day passivation solution for 90/10 copper nickel. However, nickel hydroxide is not environmentally friendly and would require application with a closed loop system.

As described hereinbelow, testing was conducted more recently by the present inventors with respect to nickel hydroxide ($Ni(OH)_2$) as the additive (dopant). More specifically, the passivation chemistry was ASTM D1141 substitute ocean water, doped with 0.5 mM $Ni(OH)_2$. The terms "additive" and "dopant" are used interchangeably herein. The present inventors tested this passivation dopant chemistry with respect to two different copper-nickel alloy compositions, viz., CDA70600 and CDA71500. This testing was conducted with respect to tubular (hollow cylindrical) copper-nickel alloy samples, which were each exposed to flow therethrough of the nickel hydroxide +ASTM SW solution.

The results of the more recent testing demonstrated improved corrosion resistance of the passive films in a reduced time period, as compared with current procedures. It was found that the implementation of $Ni(OH)_2$ as the dopant chemistry in substitute ocean water had a beneficial effect in reducing passivation periods with respect to certain commonly used copper-nickel alloys. The present inventors also tested the corrosion-resistance of these passive films against turbulent, in-service conditions, again with good results.

Passivation of copper-nickel alloys results from the formation of a duplex oxide film structure, with initial growth of an inner cuprous oxide ($Cu_2O$) film on the surface followed by slower growth of cupric oxide (CuO) or cupric hydroxychlorides ($Cu_2(OH)_3Cl$) on top of the $Cu_2O$ layer. This film requires time to form for best protection from corrosion. Enhancing the protective behavior of $Cu_2O$ in such environments has been a goal of research over the past several decades. One basic approach to accomplishing this is to identify chemical additives that develop adsorbed films on the $Cu_2O$ layer in lieu of growth of CuO. A second basic approach to improving passivation in copper nickel alloys is to identify chemical additives that promote more rapid growth of a modified outer layer film.

In adopting the second basic approach, nickel hydroxide and nickel sulfate were chosen by the present inventors as chemical additives for their more recent study. These types of additives are inorganic salts with metal cations chosen either to alter the growth of the oxide at the surface of the alloy or to interfere with the chemical reactions of corrosion. The present invention's use of nickel cations encourages deposition of Ni atoms to the $Cu_2O$ surface and promotes growth of a mixed $Ni(OH)_2$/NiO/CuO film that protects the alloy from corrosion more strongly than does CuO alone.

BRIEF DESCRIPTION OF THE DRAWINGS

The present invention will now be described, by way of example, with reference to the accompanying drawings, wherein:

FIG. 5 is a table showing passivation chemical additives and durability chemical additives that were used in testing of the present invention.

FIG. 6 is a table showing rotating cylinder electrode (RCE) and flow loop exposure conditions as they existed in testing of the present invention.

FIG. 7 shows the intact 12-inch cylinder. FIGS. 7 and 8 illustrate division of a 12-inch cylinder to produce one-inch hollow cylindrical sections, and division of a one-inch cylindrical section into two concave semi-cylindrical halves.

FIG. 9 shows the semi-cylinder having its surface in the 6 o'clock orientation. FIG. 10 shows the semi-cylinder having its surface in the 12 o'clock orientation.

FIG. 11 shows the semi-cylinder having its surface in the 6 o'clock orientation. FIG. 12 shows the semi-cylinder having its surface in the 12 o'clock orientation.

FIG. 13 shows the semi-cylinder having its surface in the 6 o'clock orientation. FIG. 14 shows the semi-cylinder having its surface in the 12 o'clock orientation.

FIG. 15 shows the semi-cylinder having its surface in the 6 o'clock orientation. FIG. 16 shows the semi-cylinder having its surface in the 12 o'clock orientation.

FIG. 17 shows the semi-cylinder having its surface in the 6 o'clock orientation. FIG. 18 shows the semi-cylinder having its surface in the 12 o'clock orientation.

FIG. 19 shows the semi-cylinder having its surface in the 6 o'clock orientation. FIG. 20 shows the semi-cylinder having its surface in the 12 o'clock orientation.

FIG. 21 shows the semi-cylinder having its surface in the 6 o'clock orientation. FIG. 22 shows the semi-cylinder having its surface in the 12 o'clock orientation.

FIG. 23 shows the semi-cylinder having its surface in the 6 o'clock orientation. FIG. 24 shows the semi-cylinder having its surface in the 12 o'clock orientation.

FIG. 25 shows the semi-cylinder having its surface in the 6 o'clock orientation. FIG. 26 shows the semi-cylinder having its surface in the 12 o'clock orientation.

FIG. 27 shows the semi-cylinder having its surface in the 6 o'clock orientation. FIG. 28 shows the semi-cylinder having its surface in the 12 o'clock orientation.

FIG. 29 shows the semi-cylinder having its surface in the 6 o'clock orientation. FIG. 30 shows the semi-cylinder having its surface in the 12 o'clock orientation.

FIG. 31 shows the semi-cylinder having its surface in the 6 o'clock orientation. FIG. 32 shows the semi-cylinder having its surface in the 12 o'clock orientation.

DESCRIPTION OF EXEMPLARY EMBODIMENTS OF THE INVENTION

Figure 1:
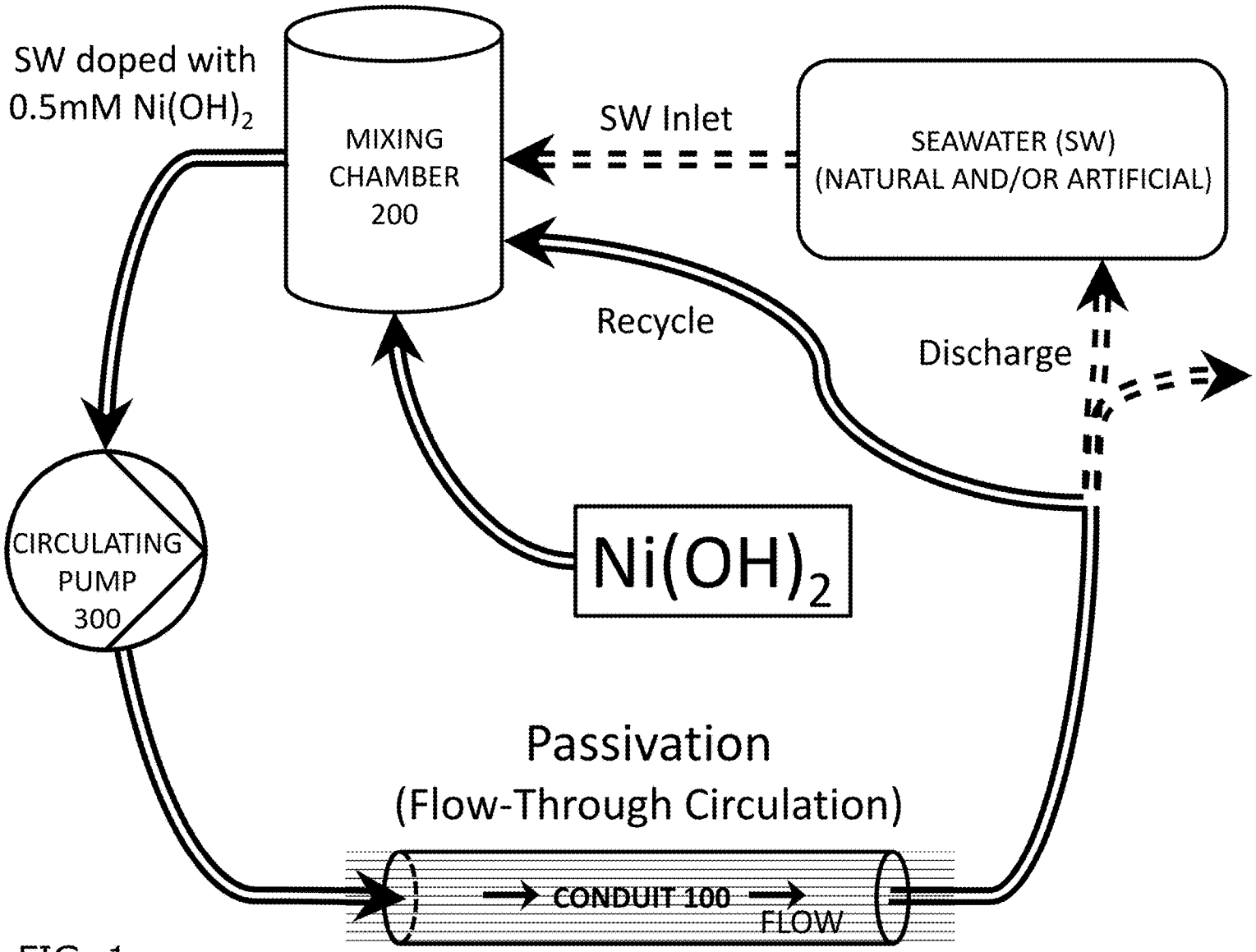
FIG. 1 is a schematic illustrating, by way of example, a closed-loop passivation system suitable for inventive practice.

Referring now to FIG. 1, a preferred inventive methodology for passivating an unpassivated copper-nickel alloy conduit 100, such as piping or tubing, involves closed-loop circulation of a solution essentially consisting of seawater (natural or artificial) and $Ni(OH)_2$ additive. A solution is made in mixing chamber 200 that combines seawater (SW) with 0.5 mM nickel hydroxide as an additive (dopant). The resultant passivation solution is pumped, via circulating pump 300, through conduit (e.g., piping or tubing) 100. As distinguished from open-loop circulation, closed-loop circulation is preferred for a passivation process utilizing a solution that includes a toxic chemical such as nickel hydroxide. It would be undesirable to discharge a substance containing nickel hydroxide into the environment, such as into a sea or ocean.

Figure 2:
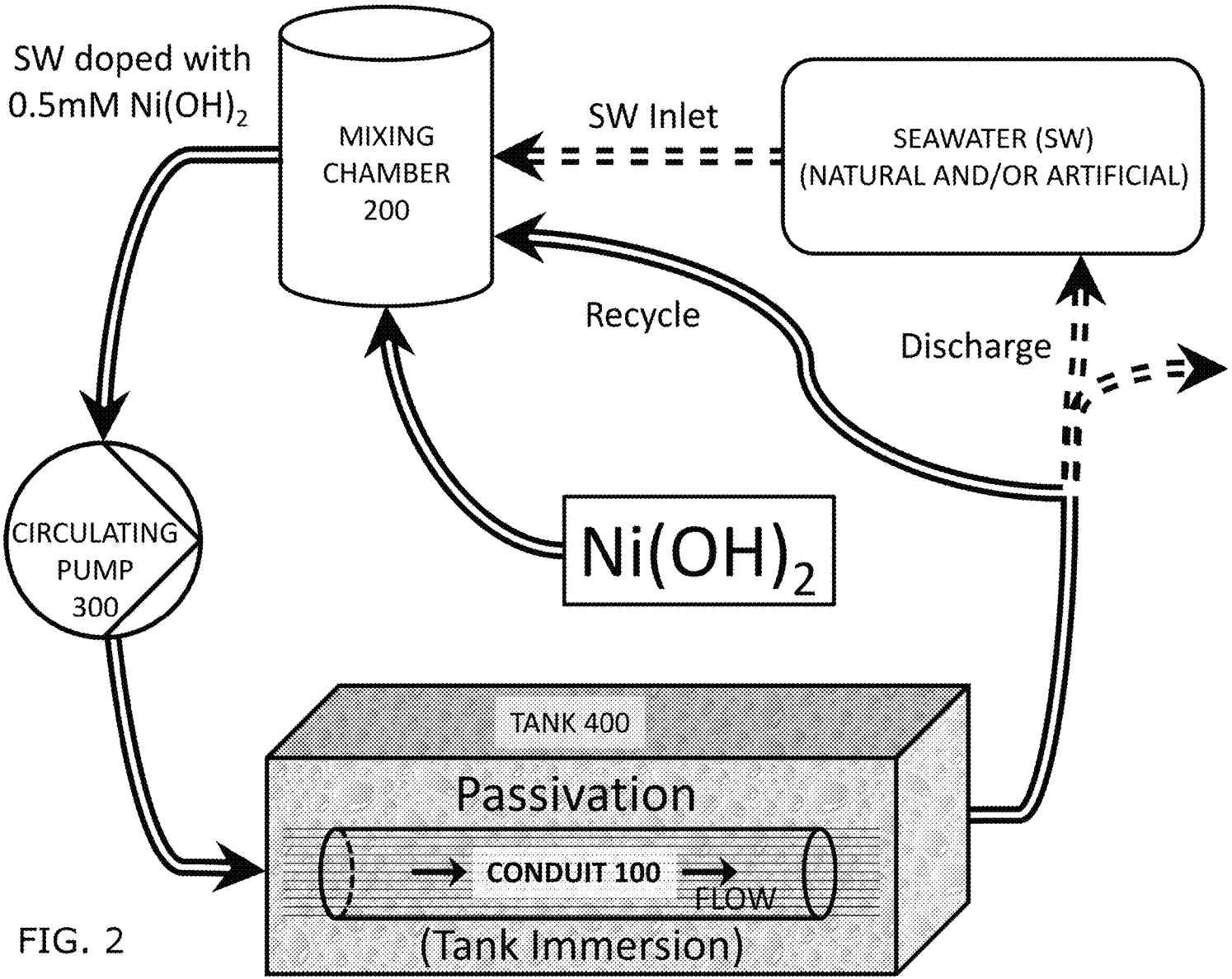
FIG. 2 is a schematic illustrating, by way of example, a different closed-loop passivation system suitable for inventive practice.

The inventive passivation solution is similarly shown to be circulated and recycled in FIGS. 1 and 2. The closed-loop passivation system shown in FIG. 2 differs from that shown in FIG. 1, mainly with respect to how the passivation solution is being applied along the length of conduit 100. According to the passivation system of FIG. 1, the passivation solution is directly caused to flow longitudinally through the interior of conduit 100. In contrast, according to the passivation system of FIG. 2, conduit 100 is situated in a tank 300 and is immersed in the passivation solution. As shown in both FIG. 1 and FIG. 2, the passivation solution is recycled into mixing chamber 200, and the cycling continues via circulation pump 300. As shown in FIG. 1, the passivation solution enters and exits conduit 100 and is recycled. As shown in FIG. 2, the passivation solution enters and exits tank 400 and is similarly recycled.

There are other notable differences between the flow-through passivation solution circulation system (FIG. 1) and the tank immersion passivation solution circulation system (FIG. 2). According to flow-through application of the passivation solution, the flowing passivation solution contacts the inside surface(s) of conduit 100 but not the outside surface(s) of conduit 100; this results in formation of a passivation film on the inside surface(s) of conduit 100 but not on the outside surface(s) of conduit 100. In contrast, according to immersive application of the passivation solution, the flowing passivation solution contacts both the inside surface(s) and the outside surface(s) of conduit 100; this results in formation of a passivation film on both the inside surface(s) and the outside surface(s) of conduit 100. Furthermore, flow that passes directly through conduit 100, such as shown in FIG. 1, tends to be more laminar than flow that passes through conduit 100 by way of immersion, such as shown in FIG. 2. As shown in FIG. 1, the flow of the seawater-plus-nickel-hydroxide solution is substantially laminar through piping 100. The laminar quality of the passivation solution flow tends to increase through straight or straighter portions of conduit 100.

The term "conduit," as used herein, broadly refers to a hollow structure, or a system or network of structures, characterized by a passage and designed to conduct fluid, e.g., liquid or gas, through the passage. A conduit may include, for instance, a hollow cylinder, a tube, a pipe, etc., or a combination of two or more of such structures (e.g., tubing or piping), and may be straight or curved or curvilinear. A conduit may be characterized by a single structure or by a system or network of structures. For instance, a conduit may include one or more straight and/or curved axisymmetric hollow structures.

Figure 4:
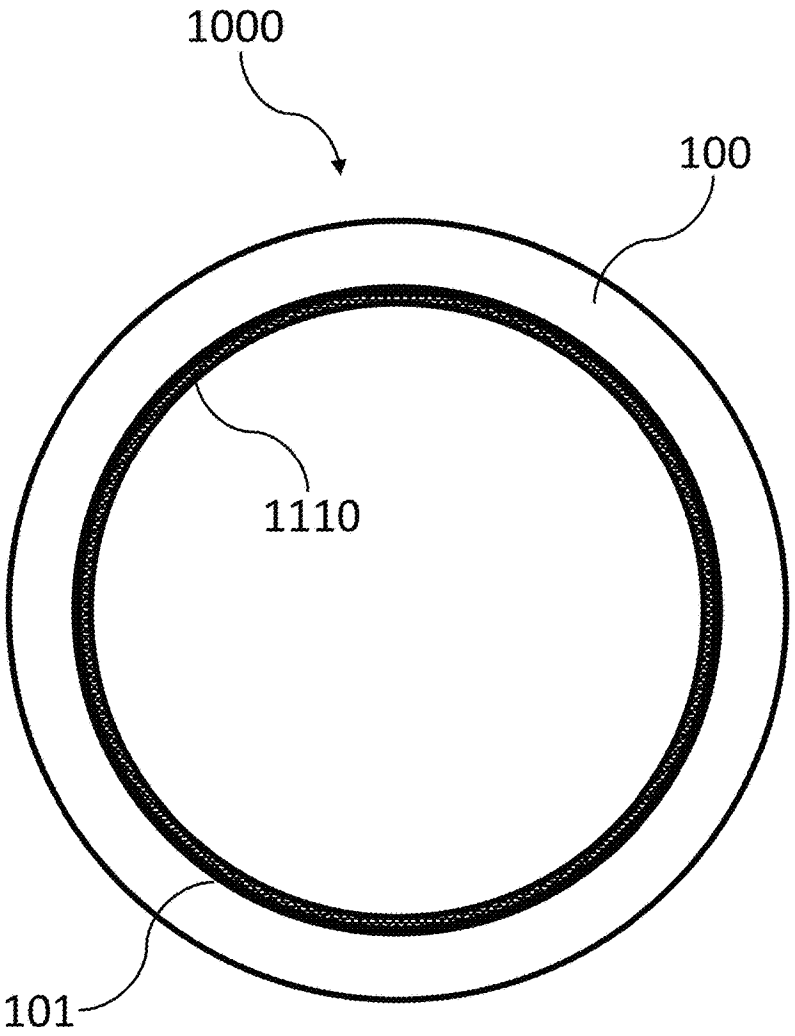
FIGS. 3 and 4 are cross-sectional views of, respectively, an unpassivated conduit (FIG. 5) and an inventively passivated conduit (FIG. 6).
Figure 3:
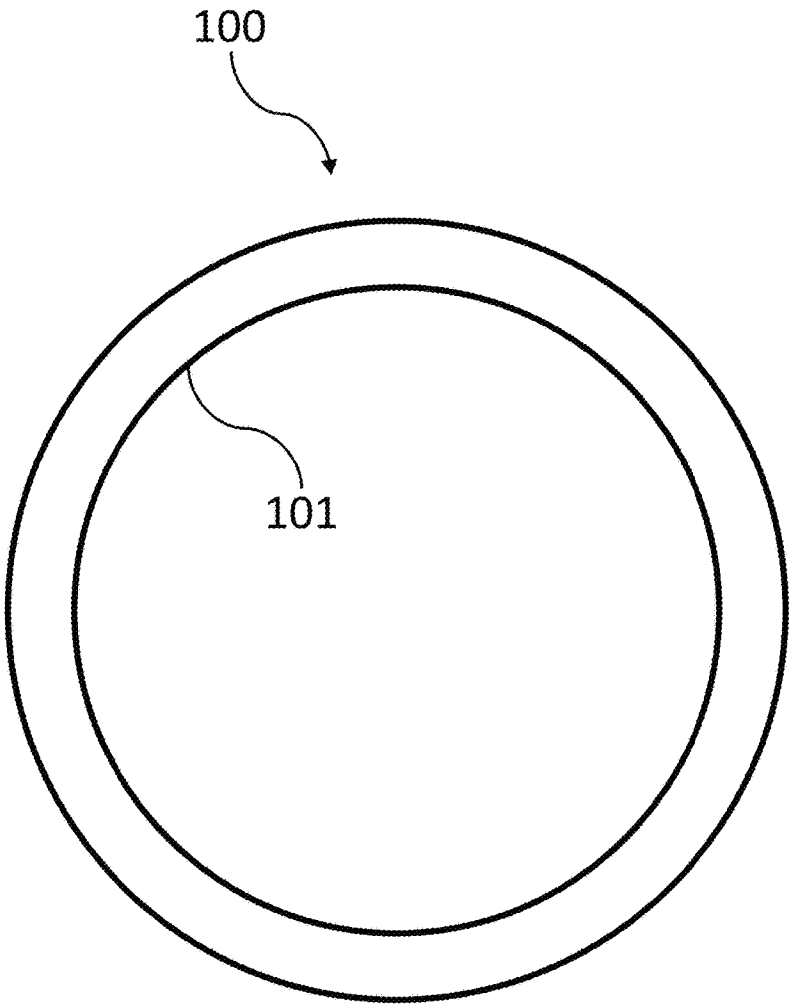

With reference to FIGS. 3 through 8, exemplary inventive practice is directed at reducing the corrosive effects of seawater when flowing through a conduit (e.g., tube, pipe, tubing, piping, hollow cylinder, etc.) made of copper-nickel alloy. As shown in FIG. 3, unpassivated hollow cylindrical conduit 100 has an inside cylindrical surface 101. As shown in FIG. 4, inventively passivated hollow cylindrical conduit 1000 has an inside passive film 1110, which over a suitable inventive passivation period (e.g., seven days) has formed upon inside cylindrical surface 101.

The present inventors performed experimentation with respect to $Ni(OH)_2$ additive treatment, with the goal of decreasing passivation times for CuNi alloys. The passivation chemistry was ASTM D1141 substitute ocean water, doped with 0.5 mM $Ni(OH)_2$. The use of 0.5 mM nickel hydroxide as a passivation chemical additive was investigated because of its promising performance in the present inventors' screening study. The experimentation essentially involved inventive passivation of unpassivated copper-nickel alloy hollow cylindrical conduit specimens 100, thereby becoming inventively passivated copper-nickel alloy hollow cylindrical conduit specimens 1000.

UNS C70600 and UNS C71500 hollow cylindrical (e.g., tubular) specimens 100 were passivated under substantially laminar-flow, low-shear stress conditions for seven days, resulting in growth of passive films 1110, and were then exposed to turbulent flow, high shear stress conditions for seven days to determine durability and performance of the grown passive films. The control passivation chemistry (ASTM D1141 substitute ocean water without additive) was similarly exposed for twenty-one days. The targeted wall shear stresses were derived from NAVSEA directives and military specifications providing the mean pipe velocity for passivation, and designed operating conditions for a double-pass condenser for surface ships. Previous study that related operating velocities from rotating cylinder electrodes (RCEs) to pipe flow was utilized to establish the appropriate parameters.

FIG. 5 presents the various passivation and durability exposure environments and their associated durations. Durability exposure environments involved either exposure of inventively passivated conduit (e.g., tube) specimens to only ASTM D1141 substitute ocean water, or exposure of inventively passivated conduit specimens to ASTM D1141 substitute ocean water with added sulfides. Inventively passivated conduit (e.g., tube) specimens were exposed to equivalent wall shear stresses and flow regimes in their respective configurations, as presented in FIG. 6.

Figure 7:
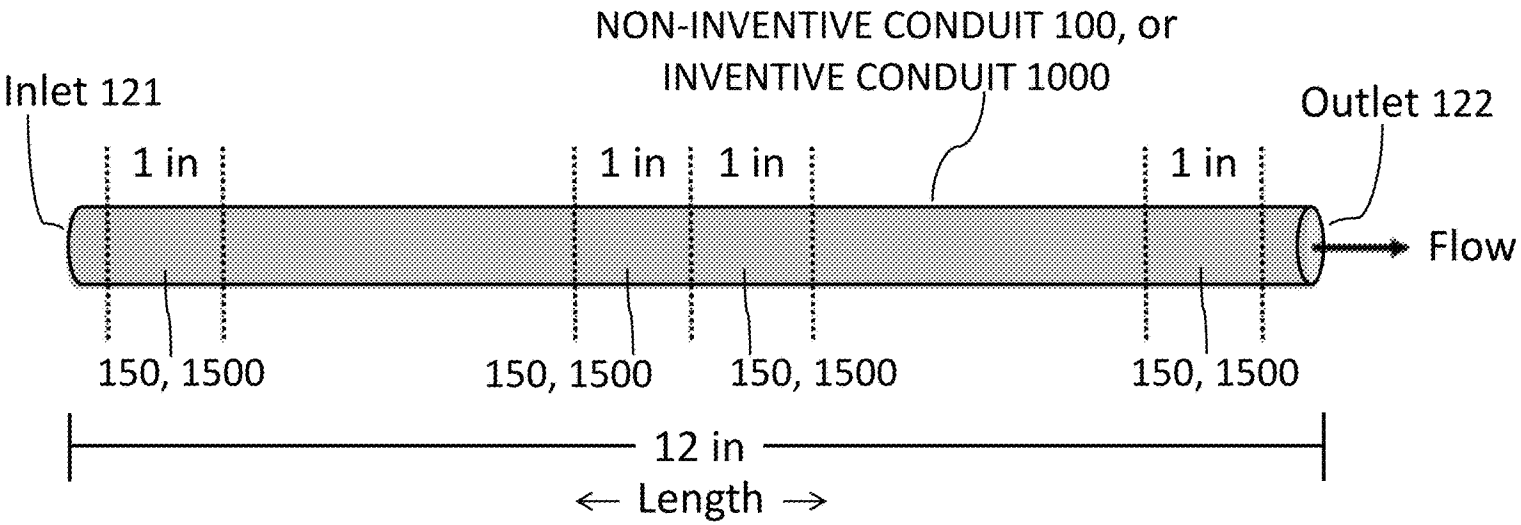
FIGS. 7 and 8 are diagrams illustrating, by way of example, a copper-nickel alloy hollow cylinder (FIG. 5) that was used in testing of the present invention.

Inventively passivated copper-nickel alloy hollow cylindrical conduit (e.g., tube) specimens 1000, such as shown in FIG. 7, were rinsed with deionized water after each exposure to ASTM D1141 substitute ocean water, doped with 0.5 mM $Ni(OH)_2$. Borescope images were taken at the entrance and exits for inventively passivated conduits 1000. The full 12-inch axial length of the inventively passivated conduit 1000 was not bore-scoped, thereby avoiding inadvertent damage to the grown passive film. The cylindrical inventively passivated conduits 1000 were sectioned (sliced or segmented) into four separate, one-inch long hollow cylindrical sections 1500, viz.: a cylindrical section 1500 at or near the inlet end 121 of inventively passivated conduit 1000; a cylindrical section 1500 at or near the outlet end 122 of inventively passivated conduit 1000; and two adjacent medial ("upstream-downstream") cylindrical sections 1500, at approximately the half-way point of inventively passivated conduit 1000. Non-inventive conduits 100 having passive film 111 were sectioned into four cylindrical sections 150.

Figure 8:
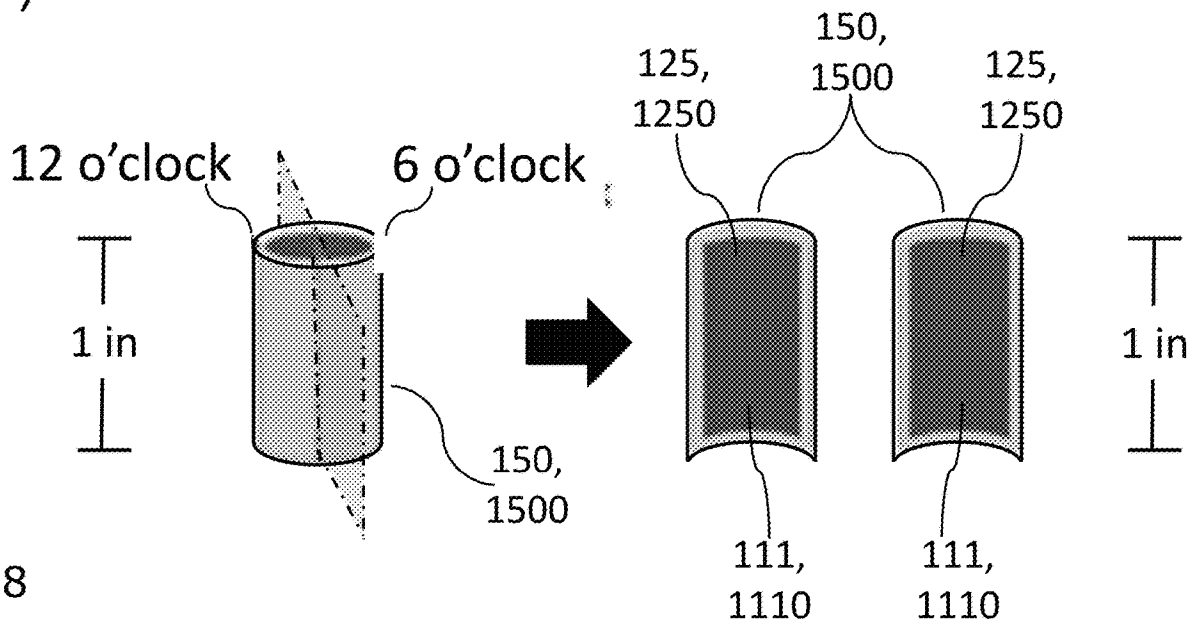

As shown in FIG. 8, the one-inch cylindrical sections were each sliced in half axially-longitudinally at the 3 o'clock and 9 o'clock orientations, thereby producing two semi-cylindrical half-sections. The halving of each cylindrical section into two semi-cylindrical sections was performed so as to expose the 6 o'clock-oriented and 12 o'clock oriented surfaces for optical analysis. All images of the semi-cylindrical halves were acquired using a Keyence VHX-2000. The semi-cylindrical specimens were stereographed at 10×, 20×, and 50× magnification.

Various reference characters are used herein to be denotive of tested cylinders and of cylindrical sections and semi-cylindrical sections that were excised by the present inventors in their testing. The reference character "100" is used herein to denote a non-inventive conduit, e.g., an unpassivated conduit or a conduit that has not been inventively passivated. The reference character "1000" is used herein to denote an inventive conduit, i.e., a conduit that has been inventively passivated. The reference character "150" is used herein to denote a cylindrical section of a non-inventive conduit 100. The reference character "1500" is used herein to denote a cylindrical section of an inventive conduit 1000. The reference character "125" is used herein to denote a semi-cylindrical section of a non-inventive conduit 100. The reference character "1250" is used herein to denote a semi-cylindrical section of an inventive conduit 1000.

After each exposure of the rotating cylinder electrodes (RCEs), the specimens were rinsed in DI water and stereographed along their exterior surface. The angular positions were documented in order to ensure photographic comparison was possible. No destructive sectioning was necessary to perform this technique. Electrochemical impedance spectroscopy (EIS) was performed on the RCE experimental setup subsequent to passivation and throughout durability flow conditions at intervals of 1, 2, 3, 4, 24, 48, and 72 hours of exposure. EIS Scans ran from 105 Hz to 10-2 Hz at an amplitude of 10 mV about the open circuit potential on a Gamry G300 potentiostat with a saturated calomel reference electrode and a carbon counter electrode. This data was generated to try to determine how long passivation treatments might last under turbulent flow conditions.

The chemical compositions and structures of passive films developed under the different exposure chemistries were investigated by performing X-ray Photoelectron Spectroscopy (XPS) on previously screened UNS C70600 and UNS C71500 coupons. One UNS C70600 specimen passivated under rotating flow with 1 mM propargyl alcohol was examined to gauge the oxidation state of copper through the depth of the passive film. Two rotating ocean water specimens per alloy were examined as controls to compare to specimens of each alloy passivated under rotating flows of the $Ni(OH)_2$ additives in ocean water.

High-resolution scans surveyed the overall composition of elements at the surface of the coupons. In addition, compositional depth profiling was carried out by subjecting the samples to 30s of 3 KV Ar-plasma sputtering between low resolution multiplex scans over binding energy spectra corresponding to 0-1s, C-1s, Cu-2p3, and Ni-2p3 peaks. The comparison of intensities for these peaks was then converted into relative atomic percent to look at the composition of the surface film as a function of sputtering time or depth from the initial surface.

With regard to visual examination, representative stereographs were taken from the downstream mid-point for each trial per parameters. Referring to FIGS. 9 through 32, these figures are presented in pairs so as to juxtapose both semi-cylindrical half-sections of the same cylindrical section.

Figure 10:
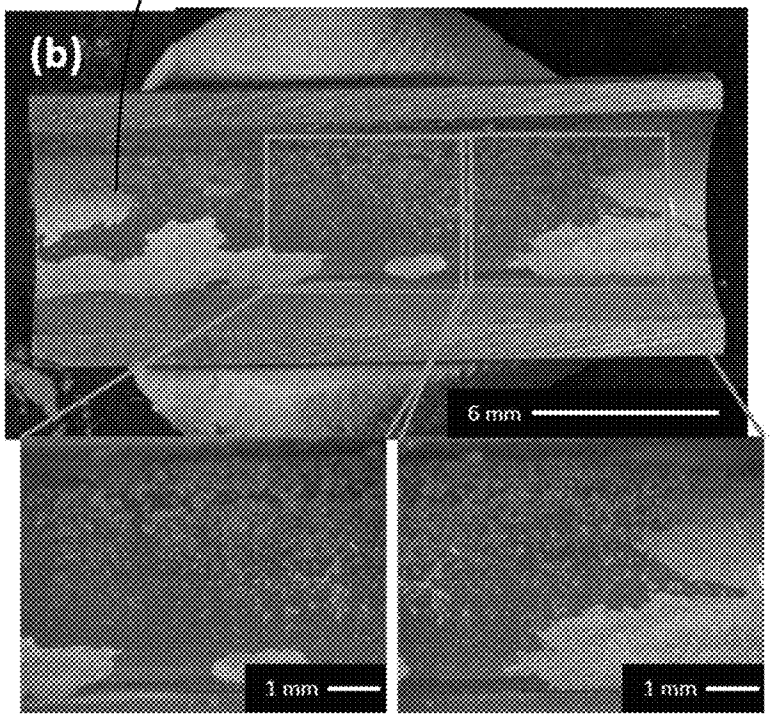
FIGS. 9 and 10 are photographic views of two semi-cylindrical halves of a UNS C70600 cylindrical section after 21 days passivation in ASTMSW, wherein the flow direction is left to right.
Figure 9:
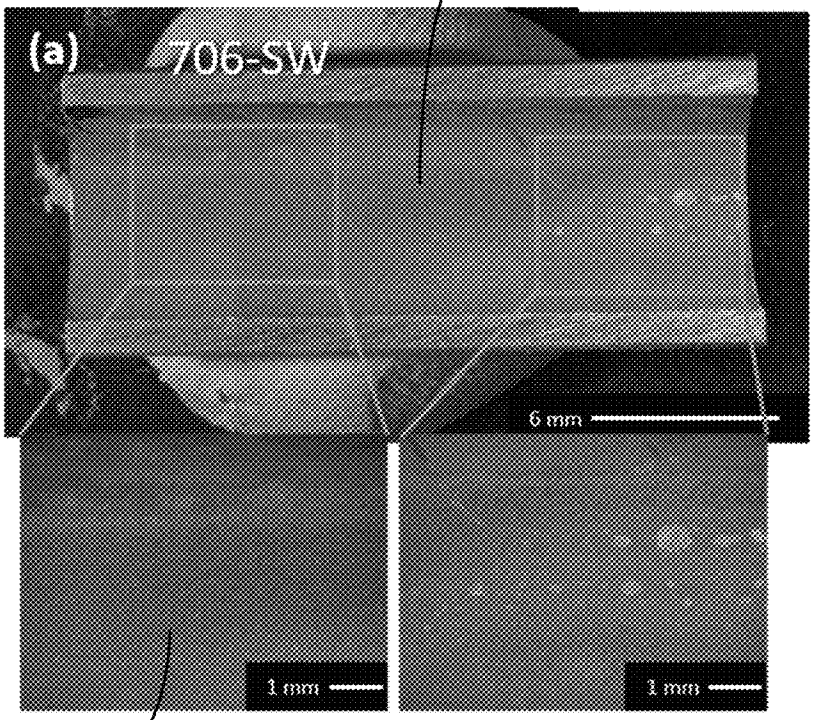

Post 21-day passivation in ASTM SW for UNS C70600 is shown in FIGS. 9 and 10. Even coverage of light brown passive film on bottom of tube and incomplete coverage of passive film on top of tube with possible light-colored salt deposits were found.

Figure 12:
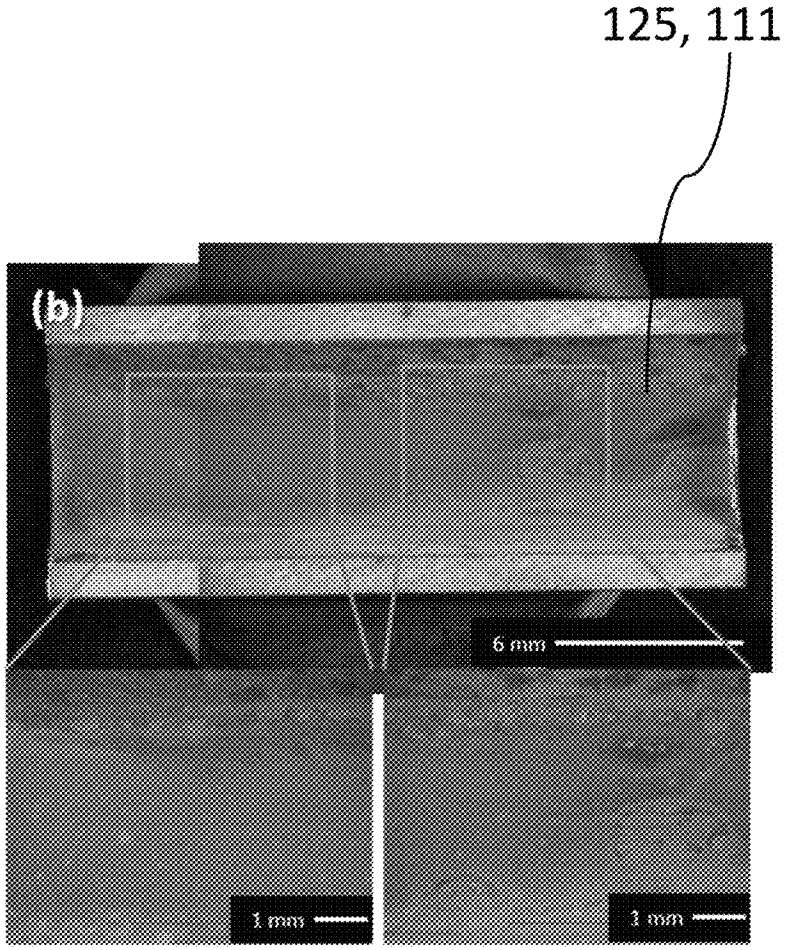
FIGS. 11 and 12 are photographic views of two semi-cylindrical halves of a UNS C70600 cylindrical section after 21 days passivation in ASTMSW and ASTMSW durability exposure, wherein the flow direction is left to right.
Figure 11:
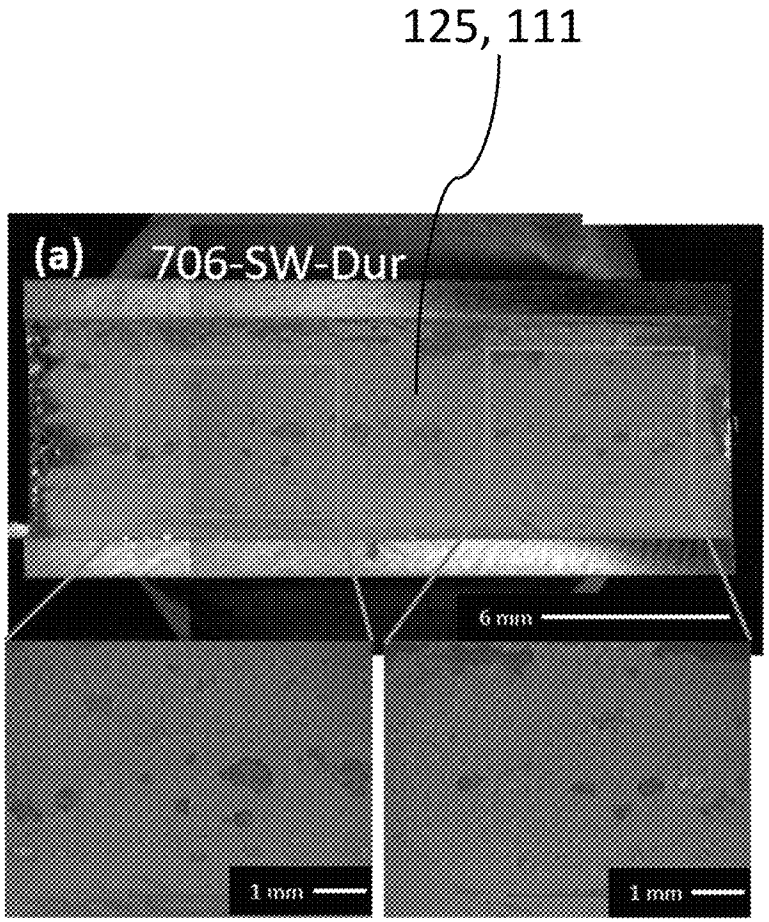

Post 21-day passivation and post seven-day durability in ASTM SW for UNS C70600 is shown in FIGS. 11 and 12. A color change of passive film from the light brown to pale yellow may indicate hydration of cuprous oxide ($Cu_2O$) to cuprous hydroxide (CuOH). Localized sites of passive film stripped from surface, but no clear indication of degradation were present.

Figure 14:
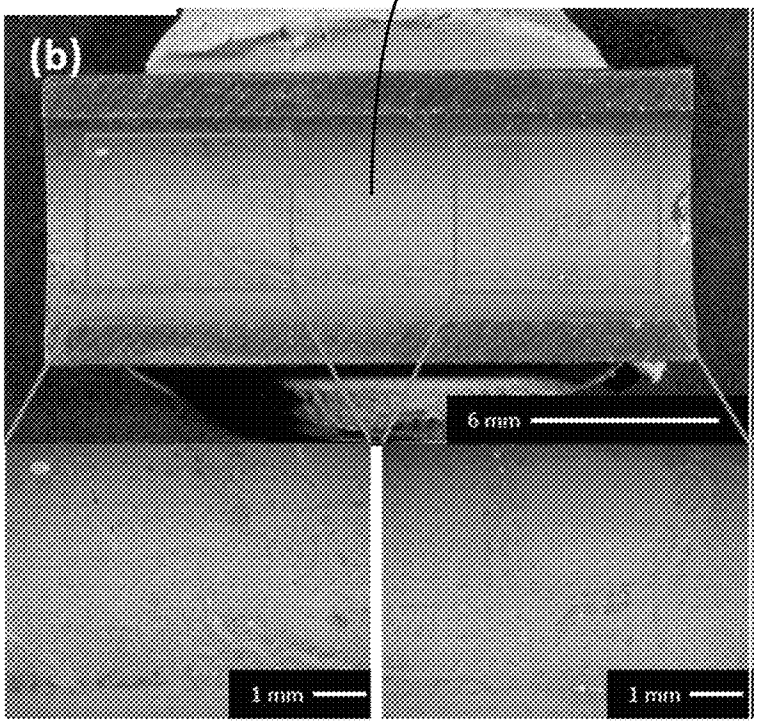
FIGS. 13 and 14 are photographic views of two semi-cylindrical halves of a UNS C70600 cylindrical section after 21 days passivation in ASTMSW and ASTMSW plus sulfide durability exposure, wherein the flow direction is left to right.
Figure 13:
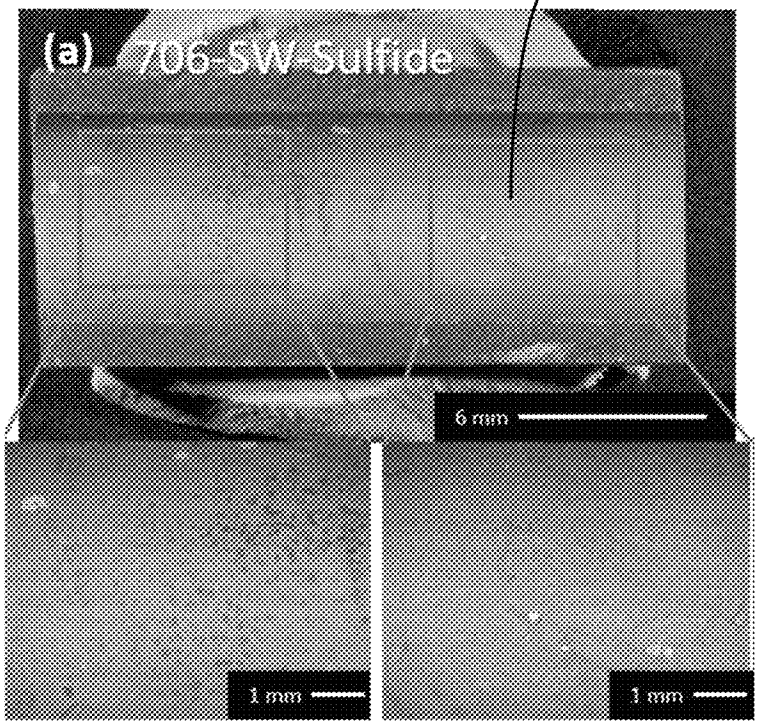

Post 21-day passivation and post seven-day durability in ASTMSW plus sulfide for UNS C70600 is shown in FIGS. 13 and 14. The passive film appears even in coverage and lighter in color than when no sulfide was present. Emergence of dark-colored regions could indicate sulfide poisoning of passive film. White deposits located near areas of dark-colored regions, could possibly be precipitated salts from incomplete rinsing after testing.

Figure 16:
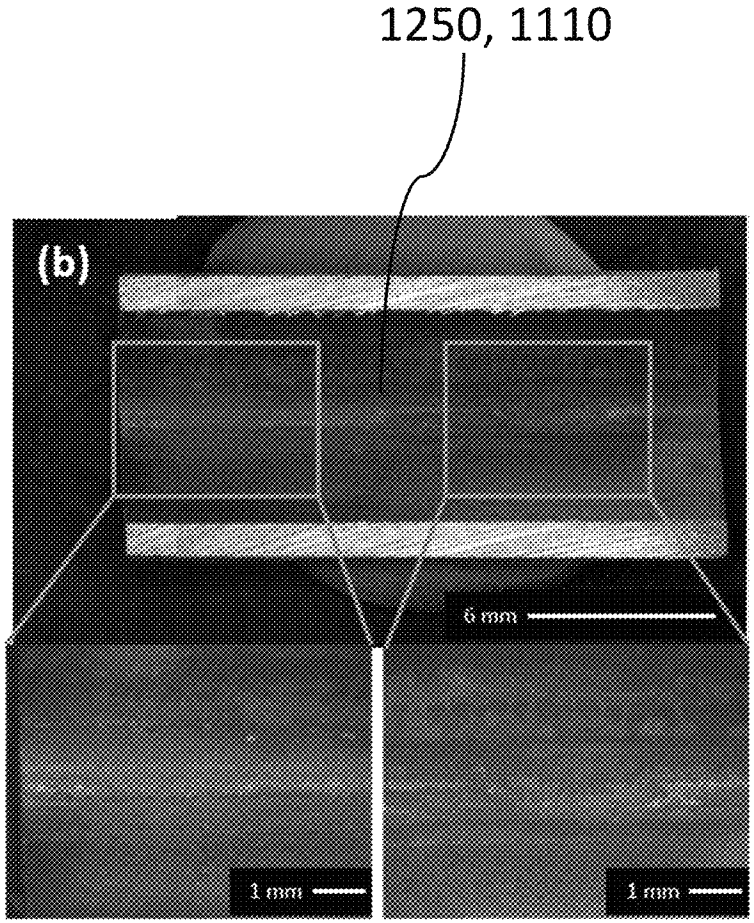
FIGS. 15 and 16 are photographic views of two semi-cylindrical halves of a UNS C70600 cylindrical section after 7 days passivation in ASTMSW+$Ni(OH)_2$, wherein the flow direction is left to right.
Figure 15:
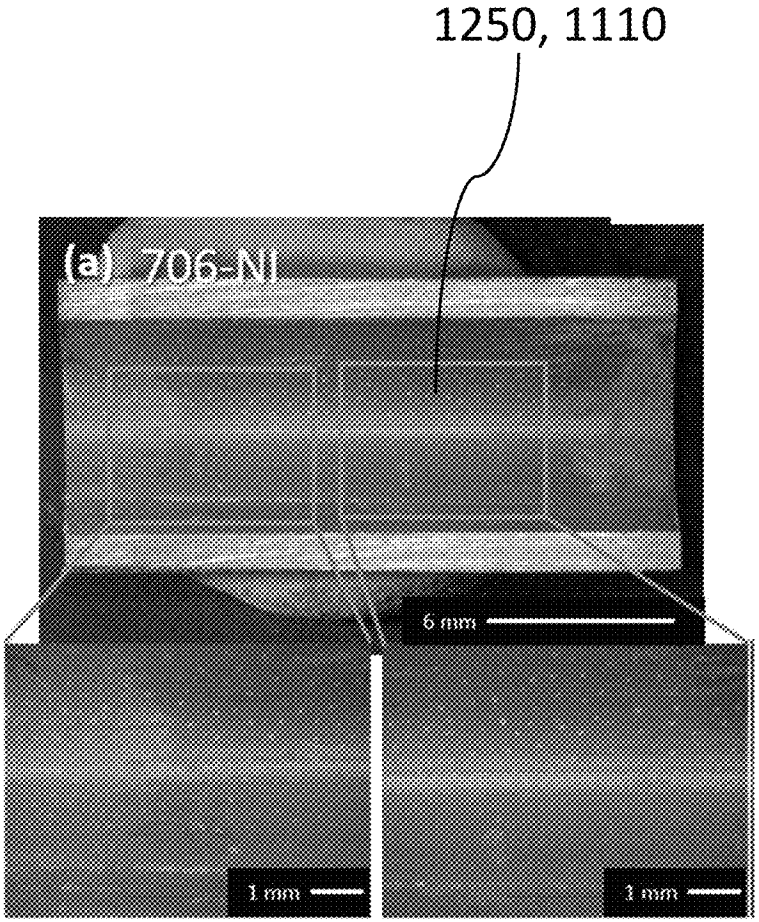

Post seven-day passivation in ASTMSW plus $Ni(OH)_2$ for UNS C70600 is shown in FIGS. 15 and 16. Even coverage of light brown passive film with slightly inhomogeneous appearance due to light-colored spots distributed throughout passive film.

Figure 18:
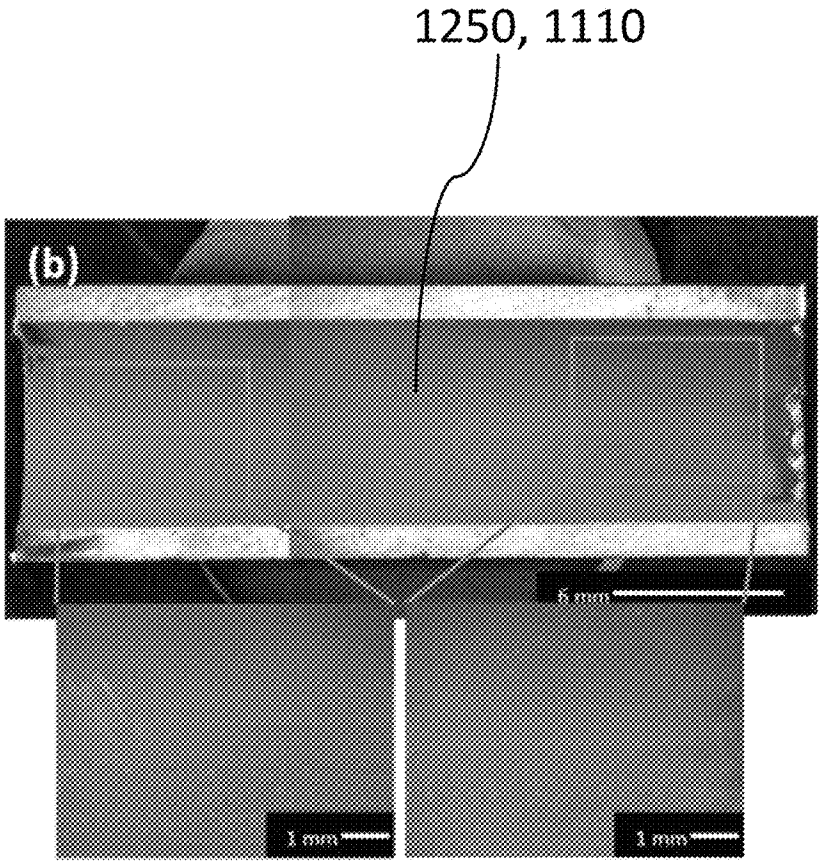
FIGS. 17 and 18 are photographic views of two semi-cylindrical halves of a UNS C70600 cylindrical section after 7 days passivation in SW+$Ni(OH)_2$ and three-week durability testing in SW, wherein the flow direction is left to right.
Figure 17:
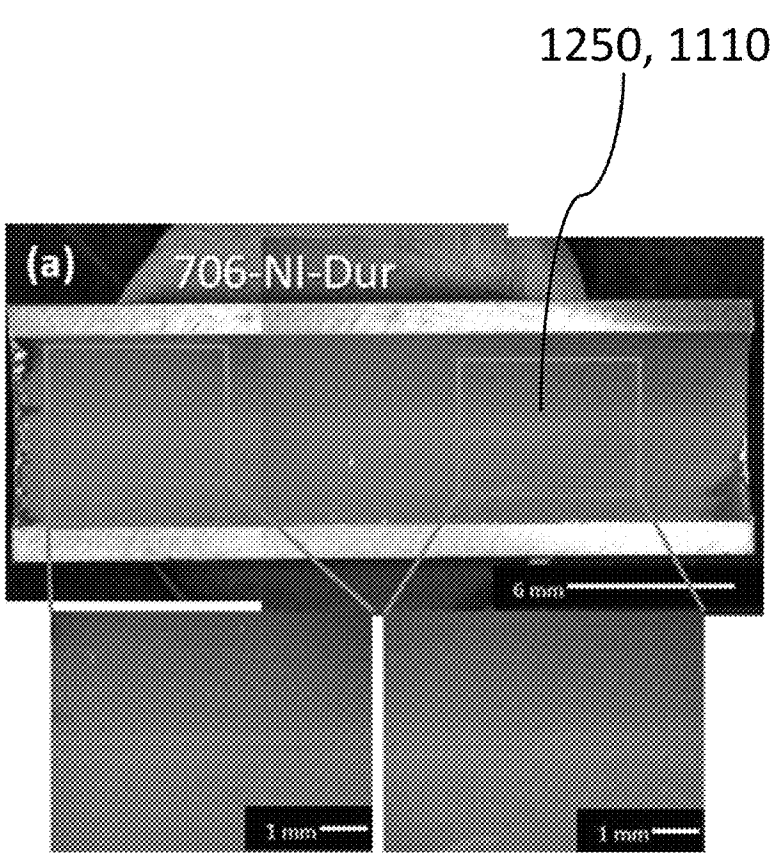

Post seven-day passivation in ASTMSW plus $Ni(OH)_2$ and post durability in ASTMSW exposure for UNS C70600 is shown in FIGS. 17 and 18. Even coverage of passive film that appears more yellow than expected light brown color may indicates hydration of $Cu_2O$ layer to CuOH. Spots seen in FIGS. 15 and 16 have disappeared in FIGS. 17 and 18. No indication of degradation or damage to passive film is present.

Figure 20:
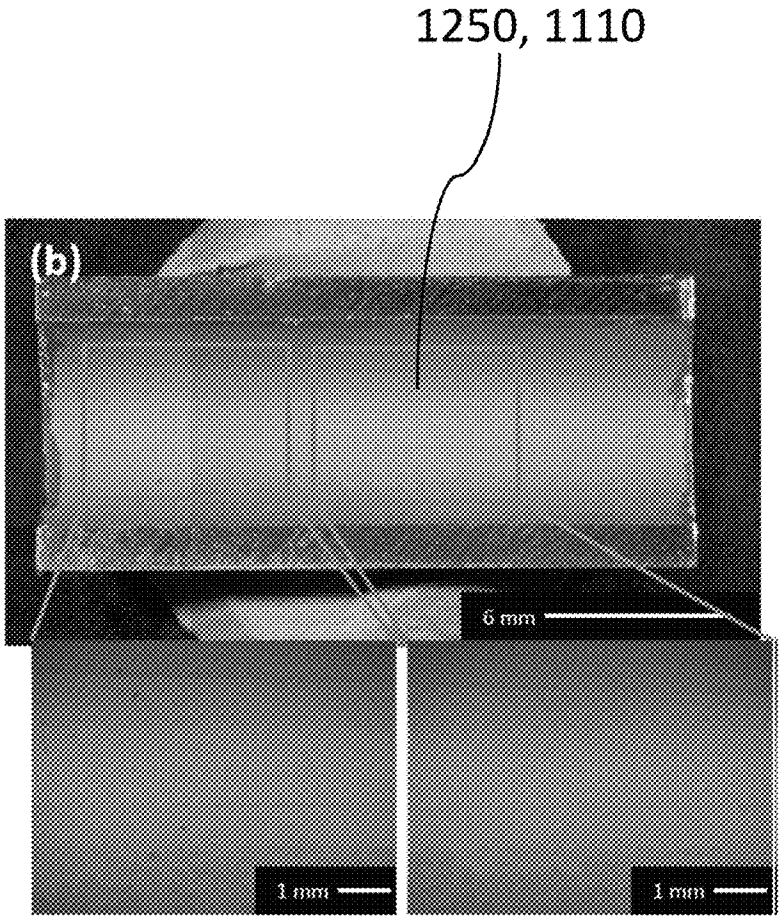
FIGS. 19 and 20 are photographic views of two semi-cylindrical halves of a UNS C70600 cylindrical section after 7 days passivation in SW+$Ni(OH)_2$ and ASTMSW plus sulfide durability exposure, wherein the flow direction is left to right.
Figure 19:
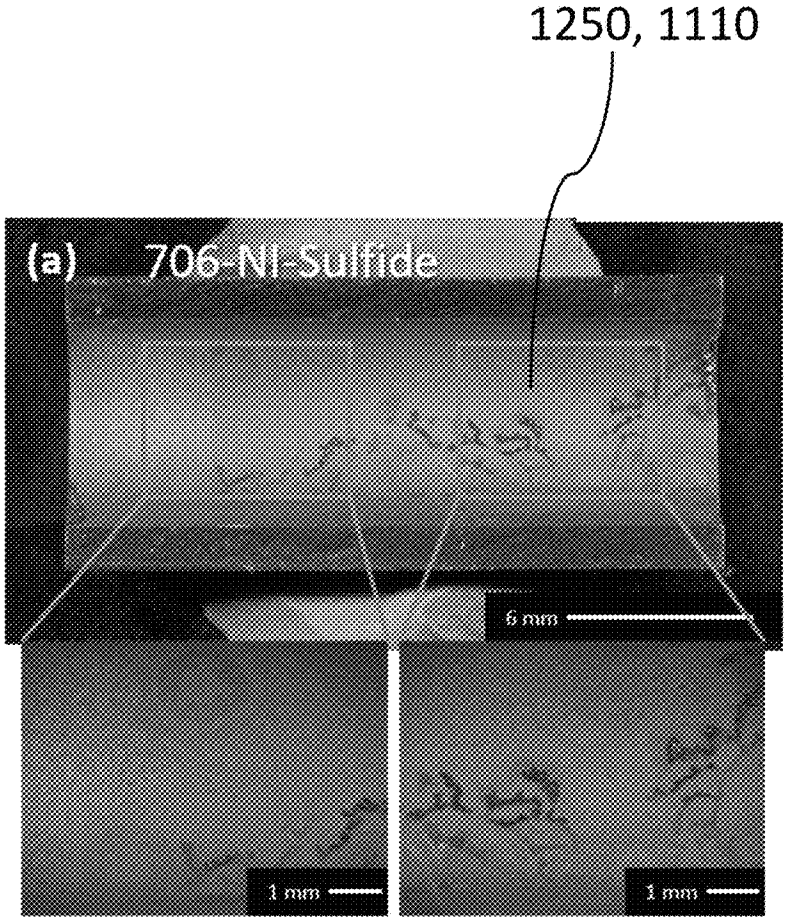

Post seven-day passivation in ASTMSW plus $Ni(OH)_2$ and post durability in ASTMSW plus sulfide durability exposure for UNS C70600 is shown in FIGS. 19 and 20. Passive film appears lighter in color than after passivation. Emergence of dark-colored regions could indicate sulfide poisoning of passive film.

Figure 22:
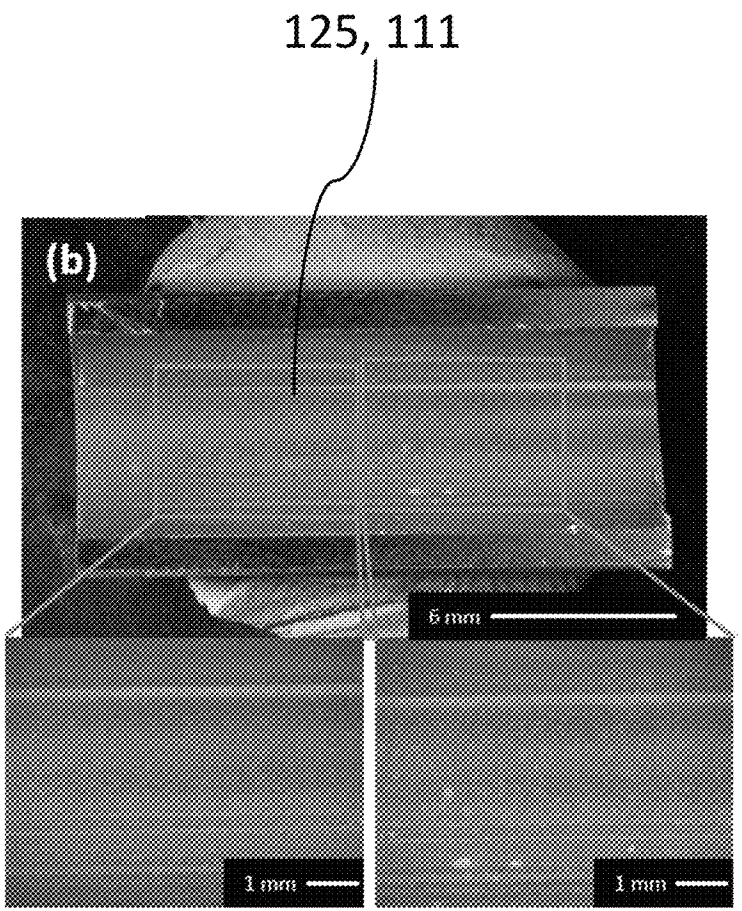
FIGS. 21 and 22 are photographic views of two semi-cylindrical halves of a UNS C71500 cylindrical section after 21 days passivation in ASTM SW, wherein the flow direction is left to right.
Figure 21:
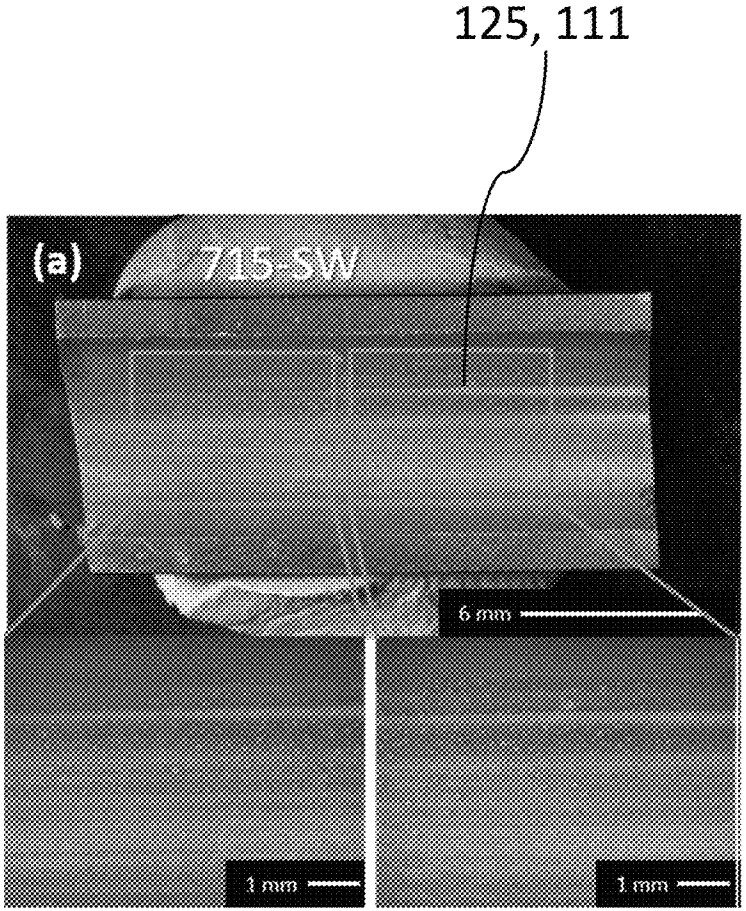

Post 21-day passivation in ASTMSW for UNS C71500 is shown in FIGS. 21 and 22. Even coverage of a translucent, brown film was found. The film has evenly distributed, light-colored inhomogeneities.

Figure 24:
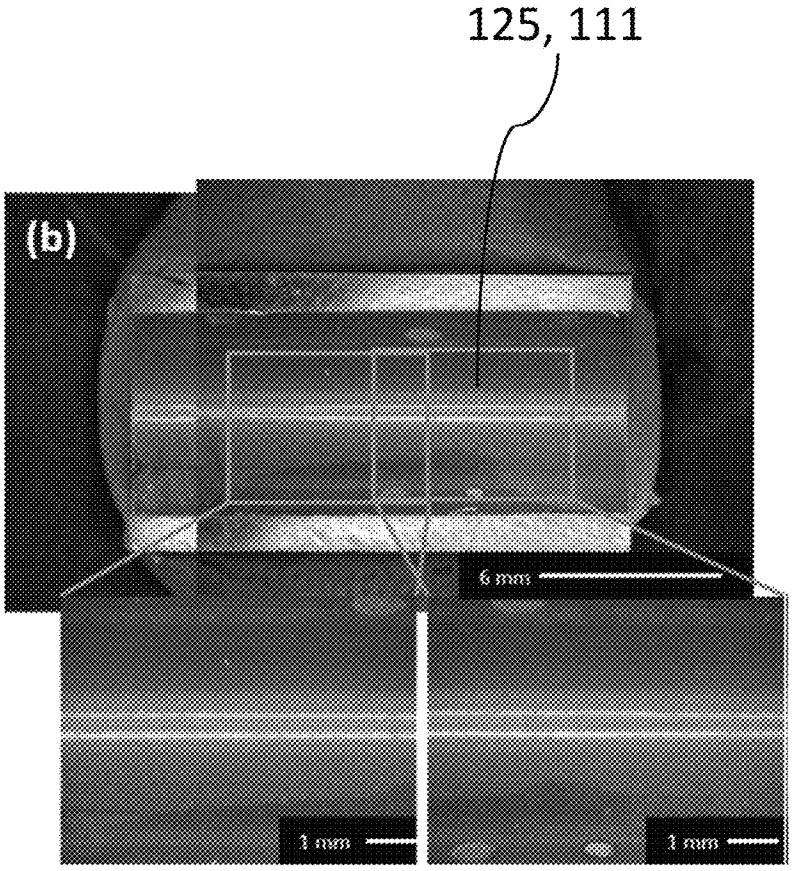
FIGS. 23 and 24 are photographic views of two semi-cylindrical halves of a UNS C71500 cylindrical section after 21 days passivation in ASTM SW and durability exposure in ASTMSW, wherein the flow direction is left to right.
Figure 23:
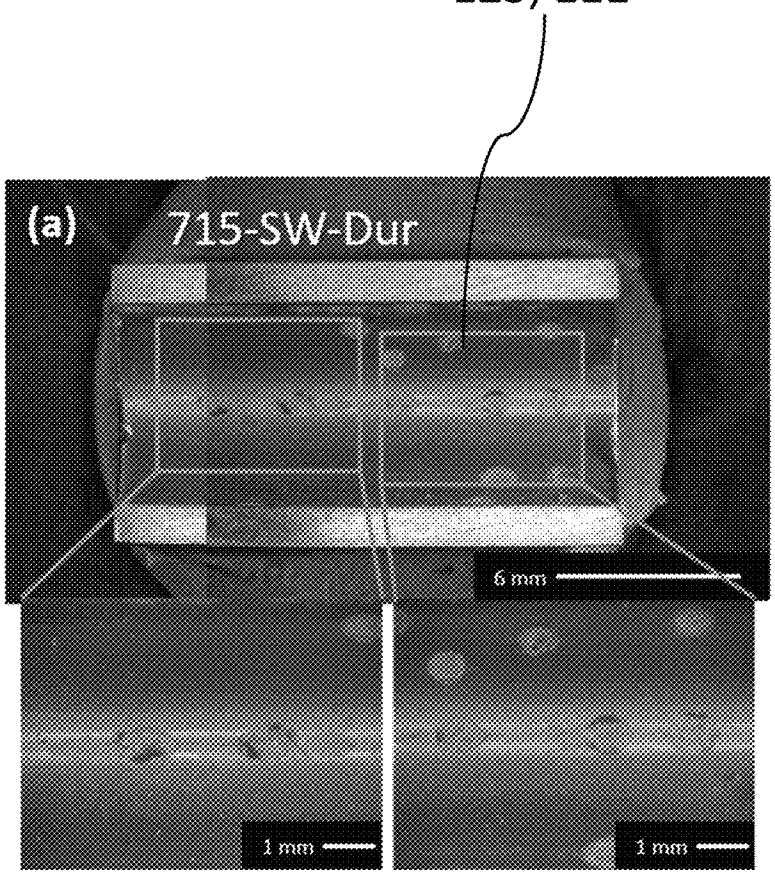

Post 21-day passivation in ASTMSW and durability exposure in ASTMSW for UNS C71500 is shown in FIGS. 23 and 24. Specimens had high luster and metallic color, suggesting passive film may have thinned or been completely stripped in durability flow conditions. Thirty-two degradation sites were identified (twenty-five from the 6 o'clock semi-cylindrical section and seven from the 12 o'clock semi-cylindrical section).

Figure 26:
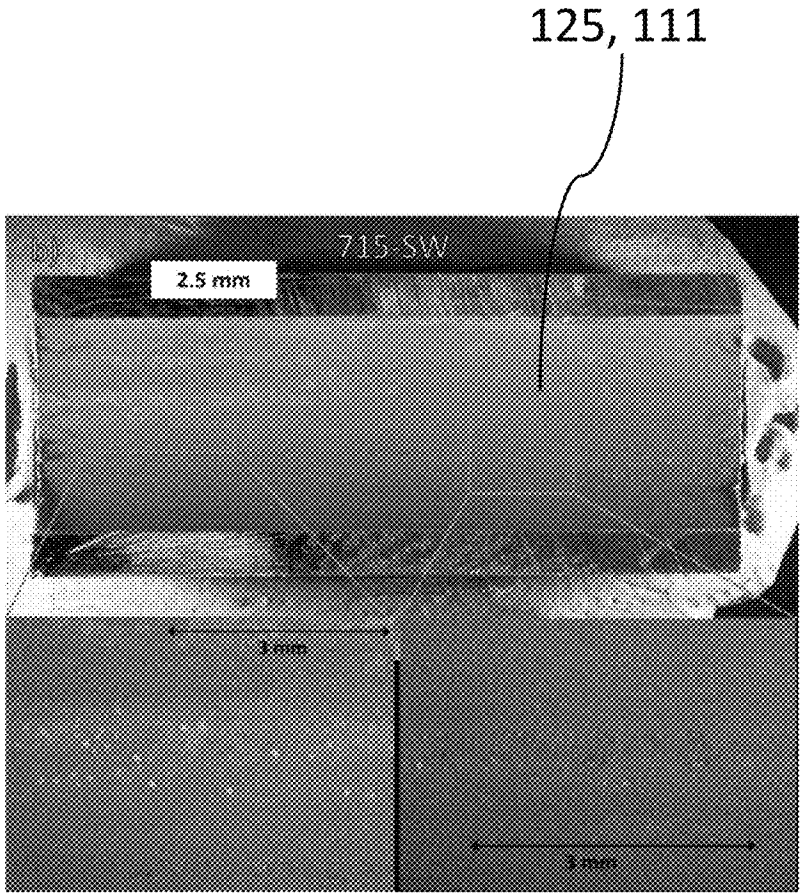
FIGS. 25 and 26 are photographic views of two semi-cylindrical halves of a UNS C71500 cylindrical section after 21 days passivation in ASTM SW and durability exposure in ASTMSW plus sulfide, wherein the flow direction is left to right.
Figure 25:
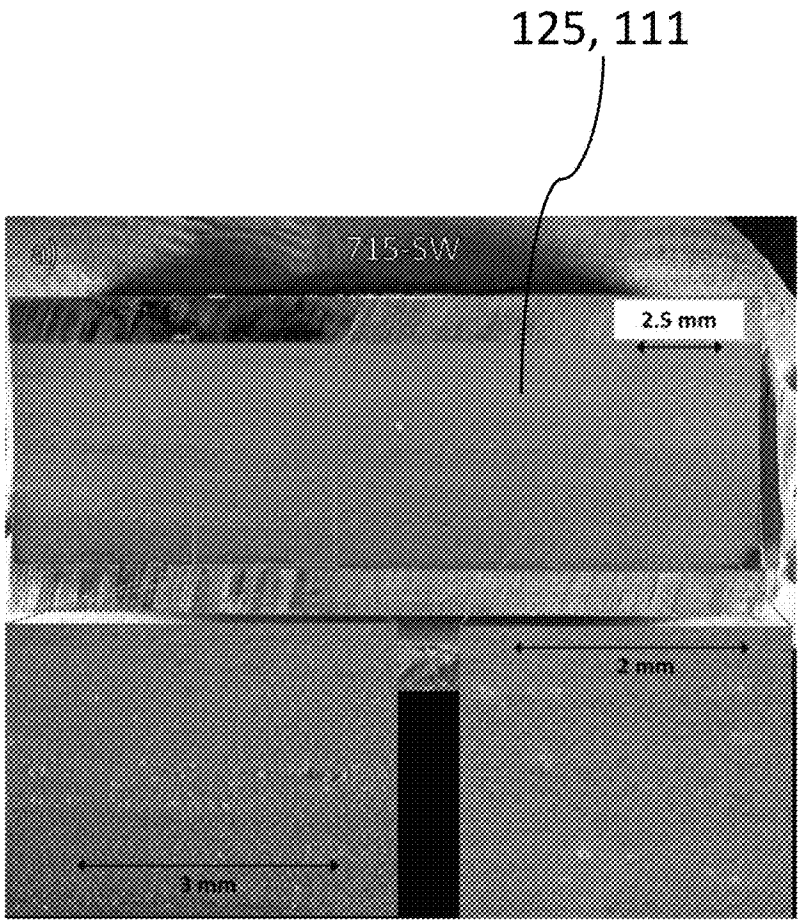

Post 21-day passivation in ASTMSW and durability exposure in ASTMSW plus sulfide for UNS C71500 is shown in FIGS. 25 and 26. Even coverage of film with increased surface roughness over the ASTMSW passivated specimens. No dark regions that may indicate sulfide poisoning were found. Additionally, scattered white-colored inhomogeneities that may be salt formations were found.

Figure 28:
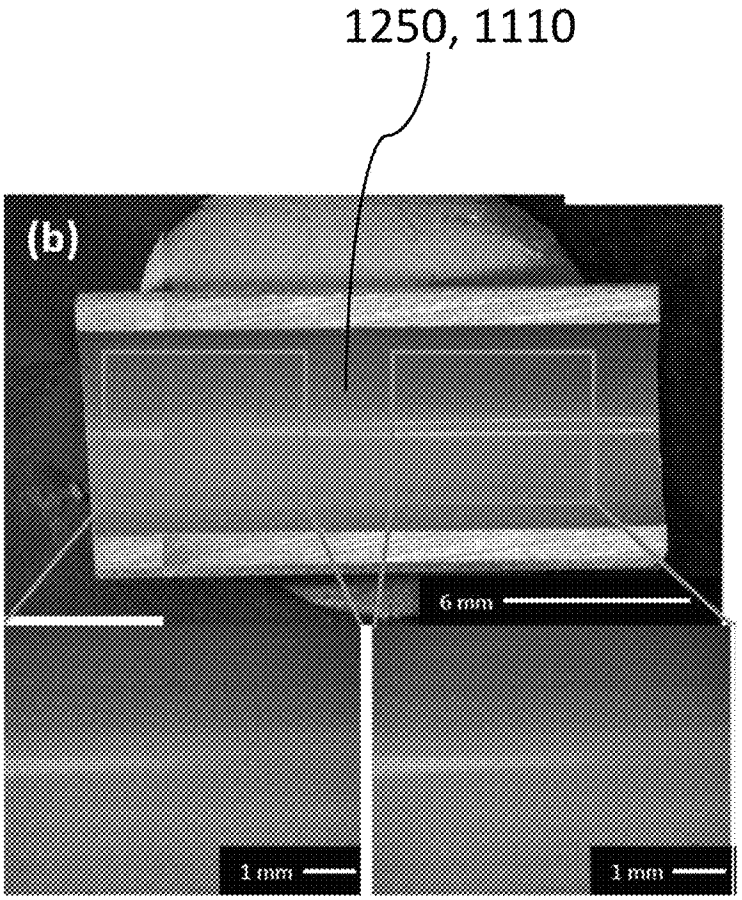
FIGS. 27 and 28 are photographic views of two semi-cylindrical halves of a UNS C71500 cylindrical section after 7 days passivation in ASTM SW plus $Ni(OH)_2$, wherein the flow direction is left to right.
Figure 27:
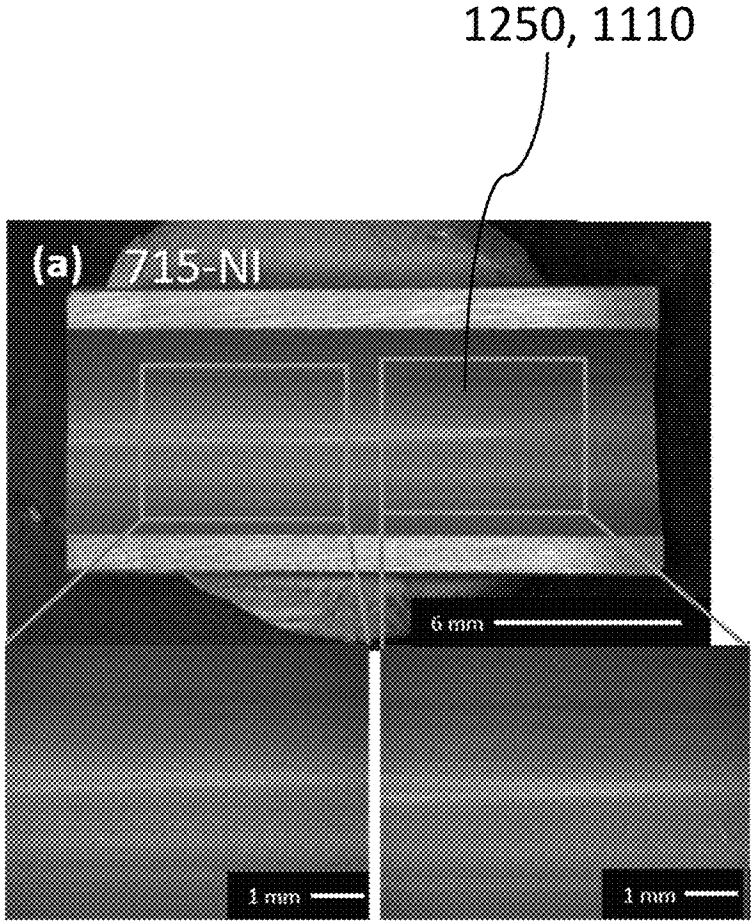

Post seven-day passivation in ASTMSW plus $Ni(OH)_2$ for UNS C71500 is shown in FIGS. 27 and 28. A yellowish brown film that was uniform in coverage was found. High luster of the film could indicate the film is translucent or thin.

Figure 30:
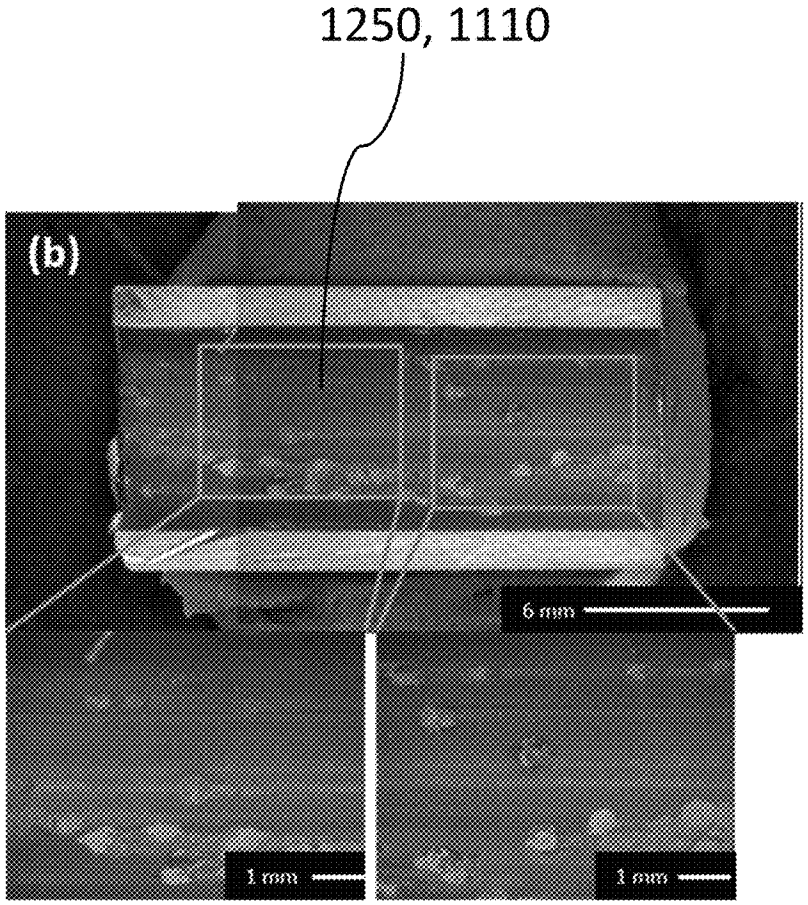
FIGS. 29 and 30 are photographic views of two semi-cylindrical halves of a UNS C71500 cylindrical section after 7 days passivation in ASTM SW plus $Ni(OH)_2$ and durability exposure in ASTMSW, wherein the flow direction is left to right.
Figure 29:
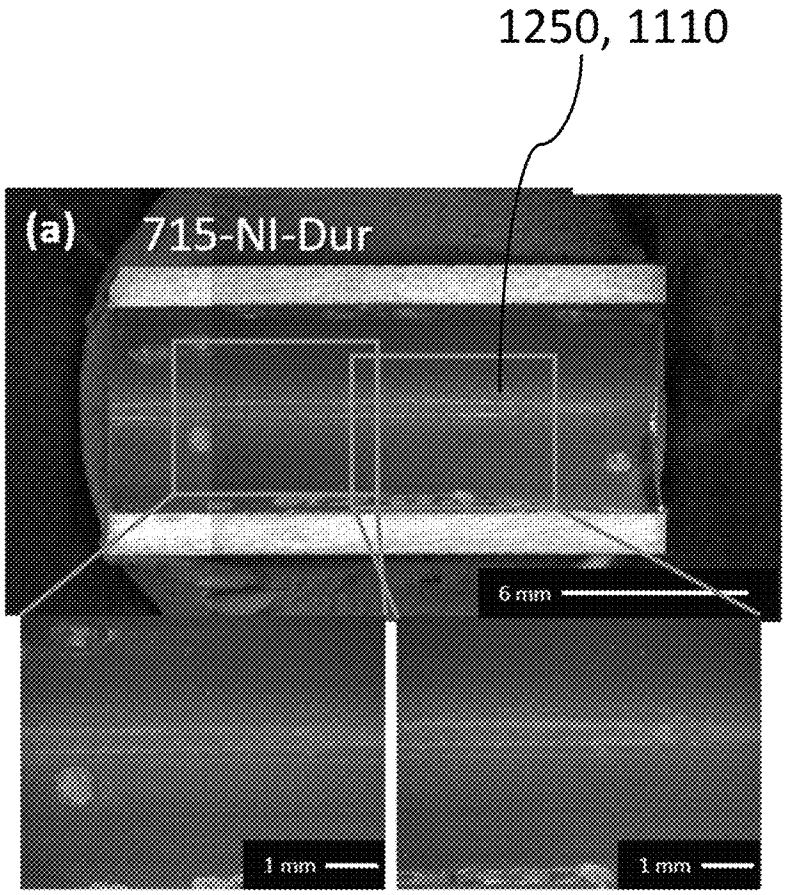

Post seven day passivation in ASTMSW plus $Ni(OH)_2$ and durability exposure in ASTMSW for UNS C71500 is shown in FIGS. 29 and 30. Passive layer appears darker brown than in $Ni(OH)_2$-passivated tube and luster is not as intense compared to the surface of durability-tested SW-passivated tube. Color change may suggest thinning of film but not complete removal. Sixty-three degradation sites were identified (twenty-three from the 6 o'clock section and forty from the 12 o'clock section). Sites primarily are clustered at similar clock positions.

Figure 32:
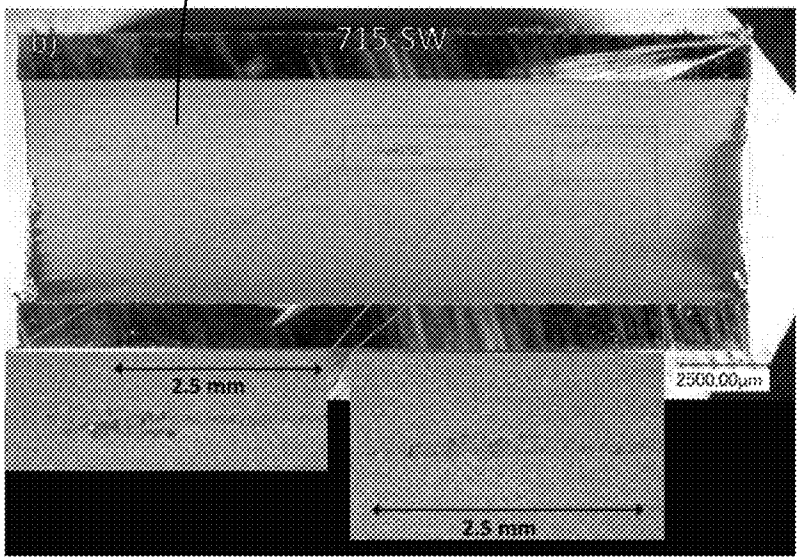
FIGS. 31 and 32 are photographic views of two semi-cylindrical halves of a UNS C71500 cylindrical section after seven days passivation in ASTM SW plus $Ni(OH)_2$ and durability exposure in ASTMSW plus sulfide, wherein the flow direction is left to right.
Figure 31:
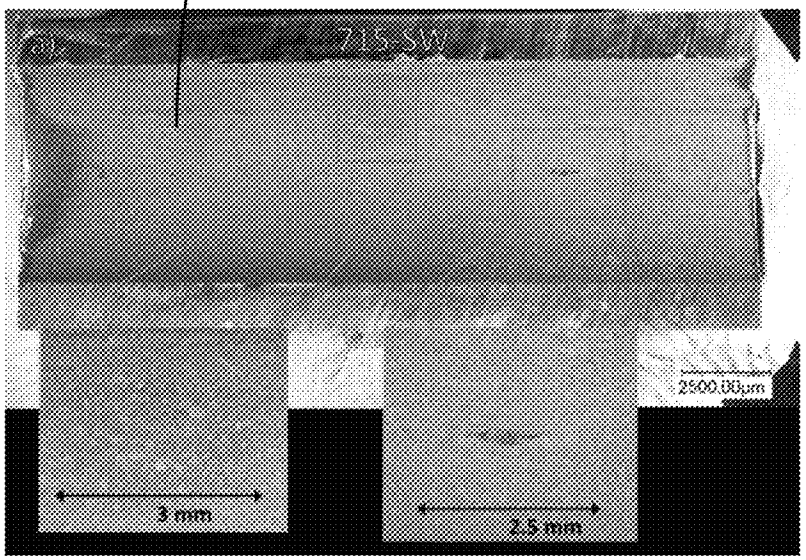

Post seven-day passivation in ASTMSW plus $Ni(OH)_2$ and durability exposure in ASTMSW plus sulfide for UNS C71500 is shown in FIGS. 31 and 32. Even coverage of a light colored film was found. Small indications of dark-colored regions that may indicate sulfide poisoning were found. Scattered white-colored inhomogeneities possibly were salt precipitates.

The passivation data collected by the present inventors fell into four categories, namely: visual examination; visual examination and EIS of RCE specimens; XPS analysis; and copper ion discharge. The present inventors' experimental results are more detailedly discussed hereinbelow with respect to: UNS C70600 21-day passivation in ASTMSW; UNS C70600 7-day passivation in ASTMSW with 0.5 mM $Ni(OH)_2$; UNS C71500 21-day passivation in ASTMSW; and UNS C71500 7-day passivation in ASTMSW with 0.5 mM $Ni(OH)_2$.

UNS C70600 21-Day Passivation in ASTMSW

The data collected on UNS C70600 alloy specimens passivated with 21-day exposure to ASTMSW provide a useful baseline for the desired qualities and performance expected of these alloys in in-service conditions. The XPS results demonstrate a robust passive layer with an approximate film thickness of 0.56 μm, comparable to thickness calculations determined through EIS measured in the preliminary screening tests. Copper ion release measurements are also comparable, showing 19 ppm released during tube passivation compared to 27 ppm in the screening test. Initial polarization resistance measured between 7-9 $k\Omega\cdot cm^2$, with an appreciable decrease to approximately 1.5 $k\Omega\cdot cm^2$ during initial exposure to durability flow conditions.

The stereographs of durability-tested tubes and RCE samples clearly demonstrate that these flow conditions greatly affect the chemistry and coverage of the initial passive film, but in both cases, clear evidence of degradation did not occur. However, the large drop in polarization resistance along with evidence of film stripping in the stereographs would indicate susceptibility of these alloys to localized corrosion in the durability flow conditions. In contrast, the Nyquist plots show Warburg impedance at all stages of exposure, which signifies that the specimen surface is under concentration polarization control and that the passive film is possibly effective as a diffusional barrier under durability flow conditions. Sulfide testing of the tubes showed lower copper ion release than in the durability testing case, but the stereographs of these tubes show incorporation of dark-colored regions into the passive film that indicate susceptibility to sulfide poisoning.

UNS C70600 Seven-Day Passivation in ASTMSW with 0.5 mM $Ni(OH)_2$

The data collected on UNS C70600 alloy specimen passivated with seven-day exposure to ASTMSW with added 0.5 mM $Ni(OH)_2$ show a marked improvement over the qualities and performance observed in the SW-passivated specimen. Despite the XPS results showing a film of about half the thickness of the SW-passivated specimen, copper ion release measurements and low-frequency impedance measurements suggest the film provides a better barrier to corrosion. Copper ion release measurements show nearly a 10× decrease from 19.7 ppm to 1.8 ppm after the course of passivation, and the low-frequency impedance measurements show higher initial values between 10-13 $k\Omega\cdot cm^2$, which decreases more slowly and less in magnitude over the course of durability flow conditions compared to the SW-passivated sample. The elevated Ni content observed in the passive layer through XPS suggests that further incorporation of Ni into the film improves barrier properties of the passive layer substantially.

The stereographs show very little damage to the passive film after one week of exposure to durability flow conditions, which might also indicate that incorporation of more Ni into the passive layer improves adherence of the passive layer to the substrate, making it more difficult to strip away. Nyquist plots of the samples show similar evidence of Warburg impedance as in the SW-passivated samples. At all points throughout degradation, the sample surface remained under concentration polarization, suggesting the effectiveness of the surface film in preventing general corrosion. With extended exposure, impedance trends tend to return to values similar to the initial surface. The stereographs of the sulfide-tested tubes do show similar dark-colored regions in the passive film that may indicate sulfide poisoning, but further experiments would be necessary to evaluate and compare this susceptibility of the $Ni(OH)_2$-passivated tubes with the SW-passivated tubes.

UNS C71500 21-Day Passivation in ASTMSW

The data collected on UNS C71500 alloy specimen passivated with 21-day exposure to ASTMSW provide a useful baseline for qualities and performance of passive layers expected of these alloys, with notable differences compared to the UNS C70600 specimen passivated with the same treatment. A large distinction is observed between the thickness the these films determined from XPS, from 0.56 μm for the UNS C70600 sample to 0.35 μm in the UNSC71500 sample. Despite the observed decrease in thickness, initial copper ion release is slightly lower at 16.0 ppm, and initial low-frequency impedance modulus is higher at 14 $k\Omega\cdot cm^2$. The larger impedance indicates improvement of the initial barrier properties, possibly attestable to larger Ni incorporation into the passive layer. The RCE measurements in durability flow conditions similarly show a significant decrease in low-frequency impedance during the first 24 hours of exposure, and Bode phase angle plots from these measurements reveal the emergence of a second time constant likely attributable to defects created in the passive layer. This would suggest the UNS C71500 alloy is more susceptible to degradation from flow-assisted corrosion than the UNS C70600 alloy.

The stereographs of durability-tested tubes support this, with clear evidence of flow-assisted corrosion damage to the surface and possible removal of the initial passive layer. Sulfide-tested tubes exhibited slightly lower copper ion release values than the durability-tested tubes, 11.7 ppm compared to 9.4 ppm, and there was no evidence of degradation observed in the stereographs of sulfide-tested tubes. The stereographs also did not show dark-colored regions of the passive film that did appear in the UNS C70600 sulfide-tested tubes, which could indicate that UNS C71500 alloys have improved resistance to sulfide poisoning.

UNS C71500 Seven-Day Passivation in ASTMSW with 0.5 mM $Ni(OH)_2$

The data collected on UNS C71500 alloy specimen passivated with 7-day exposure to ASTMSW with added 0.5 mM $Ni(OH)_2$ demonstrate improved initial barrier properties of the passive layer compared to the SW-passivated specimen but comparable performance from durability and sulfide testing. The XPS results indicate that the passive layer formed from this exposure is much thinner than the SW-passivation, decreasing from 0.35 μm to 0.07 μm. Despite this decrease in thickness, initial barrier properties appeared greatly improved, with copper ion release measurements showing a 6× decrease from 16.0 ppm to 2.4 ppm and low-frequency impedance modulus measurements showing a greater than 7× increase from 14 $k\Omega \cdot cm^2$ to 100 $k\Omega \cdot cm^2$. There was less indication of degradation of the samples during RCE measurements in durability flow conditions, lacking a discernible emergence of a second time constant in the Bode phase angle plots that would indicate defects generated in the passive layer during testing.

However, the stereographs of durability-tested tubes show a large amount of flow-assisted corrosion damage to the substrate, though the damage appears slightly smaller than that observed in the SW-passivated tubes. Further measurements would be necessary to clarify which passivation treatment leads to more severe damage. Sulfide testing of these tubes showed a larger amount of copper ions released than the SW-passivated tubes, from 9.4 ppm to 14.1 ppm, and the stereographs do show small dark-colored regions that could indicate sulfide poisoning, though to a much lesser extent compared to the UNS C70600 tubes. This suggests $Ni(OH)_2$-passivation may slightly increase susceptibility to sulfide poisoning in the UNS C71500 alloy, though further testing would be needed to evaluate and compare this susceptibility.

To recapitulate, the present invention's addition of 0.5 mM $Ni(OH)_2$ to ASTMSW results in improved barrier properties of the passivation layer for UNS C70600 and UNS C71500 alloys, as compared to passivation with ASTMSW alone. The results from $Ni(OH)_2$ passivation demonstrate the ability of the inventive treatment to reduce passivation time from 21 days to seven days of exposure for UNS C70600. For UNS C70600 alloys, the inventive treatment appears to improve adherence of the passive layer as compared to SW-passivated tubes, when under turbulent flow conditions. In contrast, for UNS C71500 alloys the $Ni(OH)_2$ treatment did not appear to improve adherence of the passive layer and greater degradation was found in $Ni(OH)_2$ treated tubes. Sulfide testing of SW-passivated tubes and $Ni(OH)_2$-passivated tubes showed comparable susceptibility to sulfide poisoning, with small indications that $Ni(OH)_2$ treatment of UNS C71500 may slightly increase that risk. However, further testing would need to be carried out to evaluate this susceptibility with certainty.

The present invention, which is disclosed herein, is not to be limited by the embodiments described or illustrated herein, which are given by way of example and not of limitation. Other embodiments of the present invention will be apparent to those skilled in the art from a consideration of the instant disclosure, or from practice of the present invention. Various omissions, modifications, and changes to the principles disclosed herein may be made by one skilled in the art without departing from the true scope and spirit of the present invention, which is indicated by the following claims.

What is claimed is:

1. A passivation method comprising:

situating a copper-nickel alloy conduit in a tank;

effecting a continuous flow of a passivation solution through said tank containing said copper-nickel alloy conduit, said passivation solution consisting essentially of seawater and 0.5 mM nickel hydroxide, said copper-nickel alloy conduit characterized by a conduit length, an inside conduit surface, and an outside conduit surface, said continuous flow of said passivation solution being effected wherein:

said copper-nickel alloy conduit is immersed in the flowing said passivation solution;

the flowing said passivation solution is contiguous, along said conduit length, with respect to said inside conduit surface and said outside conduit surface;

a passivation film forms, along said conduit length, on said inside conduit surface and said outside conduit surface, said passivation film consisting essentially of nickel hydroxide, nickel oxide, and copper oxide.

2. The passivation method of claim 1, wherein said seawater is at least one of natural seawater and artificial seawater.

3. The passivation method of claim 1, wherein the flowing said passivation solution is partially laminar with respect to said inside conduit surface.

4. The passivation method of claim 1, further comprising:

effecting a continuous turbulent flow of a durability test solution through said first copper-nickel alloy conduit when characterized by said formation of said first passivation film;

effecting a continuous turbulent flow of said durability test solution through said second copper-nickel alloy conduit when characterized by said formation of said second passivation film;

wherein said durability test solution includes seawater.

5. The passivation method of claim 1, wherein:

said continuous flow of said passivation solution is effected for a duration;

some of the flowing said passivation solution is partially laminar with respect to said inside conduit surface;

said duration is at least seven days.

6. The passivation method of claim 1, wherein:

said copper-nickel alloy conduit is characterized by two conduit ends;

said effecting of said continuous flow of said passivation solution includes repeatedly cycling said passivation solution;

said repeated cycling of said passivation solution includes motivating said passivation solution so that a portion of said passivation solution enters said copper-nickel alloy conduit at a first of said two conduit ends, a portion of said passivation solution exits said copper-nickel alloy conduit at a second of said two conduit ends, and a portion of said passivation solution reenters said copper-nickel alloy conduit at said first of said two conduit ends;

said motivating of said passivation solution includes using a circulating pump with respect to said passivation solution preceding said entry of said copper-nickel alloy conduit by a portion of said passivation solution at said first of said two conduit ends.

7. The passivation method of claim 1, wherein said continuous flow of said passivation solution is effected for a duration, and wherein said duration does not exceed 168 hours.

8. The passivation method of claim 1, wherein said formation of said passivation film is associated with deposition of nickel atoms on said second inside conduit surface.

9. A passivation test method comprising:

situating a first copper-nickel alloy conduit in a tank;

effecting a continuous flow of a first passivation solution through said tank for a first duration, said tank containing said first copper-nickel alloy conduit, said first passivation solution consisting essentially of seawater, said first copper-nickel alloy conduit characterized by a first conduit length, a first inside conduit surface, and a first outside conduit surface, said continuous flow of said first passivation solution being effected wherein:

said first copper-nickel alloy conduit is immersed in the flowing said first passivation solution;

the flowing said first passivation solution is contiguous, along said first conduit length, with respect to said first inside conduit surface and said first outside conduit surface;

a first passivation film forms, along said first conduit length, on said first inside conduit surface and said first outside conduit surface, said first passivation film characterized by a first corrosion resistance and including copper oxide;

situating a second copper-nickel alloy conduit in said tank;

effecting a continuous flow of a second passivation solution through said tank for a second duration, said tank containing said second copper-nickel alloy conduit, said second passivation solution consisting essentially of seawater and 0.5 mM nickel hydroxide, said second copper-nickel alloy conduit characterized by a second conduit length, a second inside conduit surface, and a second outside conduit surface, said continuous flow of said second passivation solution being effected wherein:

said second copper-nickel alloy conduit is immersed in the flowing said second passivation solution;

the flowing said second passivation solution is contiguous, along said second conduit length, with respect to said second inside conduit surface and said second outside conduit surface;

a second passivation film forms, along said second conduit length, on said second inside conduit surface and said second outside conduit surface, said second passivation film characterized by a second corrosion resistance and consisting essentially of nickel hydroxide, nickel oxide, and copper oxide;

wherein said second duration is less than said first duration, and wherein said second corrosion resistance is greater than said first corrosion resistance.

10. The passivation test method of claim 9, wherein said second duration is at least seven days.

11. The passivation test method of claim 9, wherein the flowing said first passivation solution is partially laminar with respect to said first inside conduit surface, and wherein the flowing said second passivation solution is partially laminar with respect to said second inside conduit surface.

12. The passivation test method of claim 9, wherein:

said first copper-nickel alloy conduit is characterized by two first conduit ends, wherein said effecting of said continuous flow of said first passivation solution includes repeatedly cycling said first passivation solution, and wherein said repeated cycling of said first passivation solution includes motivating said first passivation solution so that a portion of said first passivation solution enters to said first copper-nickel alloy conduit at a first of said two first conduit ends, a portion of said first passivation solution exits said first copper-nickel alloy conduit at a second of said two first conduit ends, and a portion of said first passivation solution reenters said first copper-nickel alloy conduit at said first of said two first conduit ends;

said second copper-nickel alloy conduit is characterized by two second conduit ends, wherein said effecting of said continuous flow of said second passivation solution includes repeatedly cycling said second passivation solution, and wherein said repeated cycling of said second passivation solution includes motivating said second passivation solution so that a portion of said first passivation solution enters said second copper-nickel alloy conduit at a first of said two second conduit ends, a portion of said first passivation solution exits said second copper-nickel alloy conduit at a second of said two second conduit ends, and a portion of said first passivation solution reenters said second copper-nickel alloy conduit at said first of said two second conduit ends.

13. The passivation test method of claim 12, wherein:

said motivating of said first passivation solution includes using a circulating pump with respect to said first passivation solution preceding said entry of said first copper-nickel alloy conduit by a portion of said first passivation solution at said first of said two first conduit ends;

said motivating of said second passivation solution includes using a circulating pump with respect to said second passivation solution preceding said entry of said second copper-nickel alloy conduit by a portion of said second passivation solution at said first of said two second conduit ends.

14. The passivation method of claim 9, wherein said seawater is at least one of natural seawater and artificial seawater.

15. The passivation test method of claim 9, further comprising:

effecting a continuous turbulent flow of a durability test solution through said first copper-nickel alloy conduit when characterized by said formation of said first passivation film;

effecting a continuous turbulent flow of said durability test solution through said second copper-nickel alloy conduit when characterized by said formation of said second passivation film;

wherein said durability test solution includes seawater.

16. The passivation test method of for making a conduit as recited in claim 9, wherein the method further comprises:

subsequent to said effecting of said continuous flow of said first passivation solution, removing a first specimen, said first specimen removed from said first copper-nickel alloy conduit as characterized by said first passivation film, said first specimen characterized by a specimen portion of said first passivation film;

testing said specimen portion of said first passivation film in terms of barrier effectiveness of said first specimen portion of said first passivation film with respect to seawater;

subsequent to said effecting of said continuous flow of said second passivation solution, removing a second specimen, said second specimen removed from said second copper-nickel alloy conduit as characterized by said second passivation film, said second specimen characterized by a specimen portion of said second passivation film;

testing said specimen portion of said second passivation film in terms of barrier effectiveness of said second specimen portion of said second passivation film with respect to seawater.

17. The passivation test method of claim 16, wherein:

said effecting of said continuous flow of said second passivation solution is performed for at least two different said second durations;

said testing of a said second specimen portion is performed with respect to each of said at least two different said second durations.

* * * * *